US008085220B2

(12) United States Patent
Nobuki et al.

(10) Patent No.: US 8,085,220 B2
(45) Date of Patent: Dec. 27, 2011

(54) PLASMA DISPLAY APPARATUS

(75) Inventors: Shunichiro Nobuki, Kokubunji (JP); Norihiro Uemura, Hitachi (JP); Masakazu Sagawa, Inagi (JP); Keizo Suzuki, Kodaira (JP); Yoshiro Mikami, Hitachiota (JP); Hideto Momose, Hitachiota (JP); Shirun Ho, Tokyo (JP)

(73) Assignee: Hitachi, Ltd., Tokyo (JP)

( * ) Notice: Subject to any disclaimer, the term of this patent is extended or adjusted under 35 U.S.C. 154(b) by 611 days.

(21) Appl. No.: 12/323,592

(22) Filed: Nov. 26, 2008

(65) Prior Publication Data

US 2009/0225008 A1 Sep. 10, 2009

(30) Foreign Application Priority Data

Mar. 7, 2008 (JP) ..... 2008-057164

(51) Int. Cl.
*G09G 3/28* (2006.01)

(52) U.S. Cl. ..... 345/60

(58) Field of Classification Search ..... 345/60, 345/63, 65, 66, 67, 71, 72; 313/585; 429/69
See application file for complete search history.

(56) References Cited

U.S. PATENT DOCUMENTS 3,440,098 A * 4/1969 Stachurski ..... 429/69
5,754,004 A * 5/1998 Miyagawa et al. ..... 313/585
6,686,897 B2 * 2/2004 Huang et al. ..... 345/66
6,714,175 B1 * 3/2004 Shimada et al. ..... 345/60
6,856,305 B2 * 2/2005 Nagano ..... 345/60
7,609,231 B2 * 10/2009 Kwon et al. ..... 345/60
2005/0093776 A1 * 5/2005 Furutani et al. ..... 345/60
2009/0015520 A1 * 1/2009 Akamatsu et al. ..... 345/67

FOREIGN PATENT DOCUMENTS

JP 2002-297091 10/2002
JP 2003-217458 7/2003

* cited by examiner

*Primary Examiner* — Fred Tzeng
(74) *Attorney, Agent, or Firm* — Antonelli, Terry, Stout & Kraus, LLP.

(57) ABSTRACT

A plasma display apparatus having a priming discharge region PDC partitioned from a display discharge cell DDC, by a traverse rib, at a side where the second electrode between the display discharge cell DDC adjacent in a row direction is adjacent; a second longitudinal rib partitioning the priming discharge region PDC; a third longitudinal rib, further partitioning a region partitioned by the second longitudinal rib into two sections; a convex electrode; and a gap connecting the display discharge cell DDC and the priming discharge cell PDC, wherein a sum of a width in a line direction of a nearly rectangular space region containing adjacent two priming discharge cells PDCs, and a pattern width of the second longitudinal rib is designed larger than a sum of a width in the row direction and a pattern width of the traverse rib.

26 Claims, 30 Drawing Sheets

PLASMA DISPLAY APPARATUS

INCORPORATION BY REFERENCE

The present application claims priority from Japanese application JP 2008-057164 filed on Mar. 7, 2008, the content of which is hereby incorporated by reference into this application.

BACKGROUND OF THE INVENTION

The present invention relates to a plasma display panel (hereafter may also be referred to as PDP), and a plasma display apparatus including a drive apparatus.

In recent years, as a large-size and thin-type color display apparatus, practical application of an alternating current (AC) surface discharge-type PDP has been progressing. Explanation will be given below on embodiments of the AC surface discharge-type PDP which is conventional technology.

FIG. 2 is an example of a disassembled perspective view showing a part of a structure of a general AC surface discharge-type PDP. A PDP 38 shown in FIG. 2 is one configured by a front plate 36 composed of a glass front substrate 21 or the like, and a rear plate 37 composed of a rear substrate 28 or the like, which are adhered to make one piece.

The front substrate 21 has a plurality of sustained discharge electrode pairs formed in parallel with a constant distance apart. This sustained discharge electrode pair is configured by an X electrode 22 (hereafter may also be referred to as X), which is a first electrode, and a Y electrode 23 (hereafter may also be referred to as Y), which is a second electrode. The X electrode 22 is configured by an X transparent electrode 22*a* and an X bus electrode 22*b*, which aims at compensation of electric conductivity of the transparent electrode. In addition, the Y electrode 23, similarly, is configured by a Y transparent electrode 23*a* and a Y bus electrode 23*b*. The X bus electrode 22*b* and the Y bus electrode 23*b* are provided extending in a direction of the arrow mark D2 (line direction) in FIG. 2. The X electrode 22 and the Y electrode 23 are covered with a dielectric layer 26, and this dielectric layer 26 is covered with a protective film 27.

In FIG. 2, a plurality of the sustained discharge electrode pairs are arranged to form X-Y-Y-X-X-Y-Y-X-X--- in a direction of the arrow mark D1. Such an arrangement is called an XYYX arrangement. On the other hand, it may be arranged to form X-Y-X-Y-X-Y-X-Y---. Such an arrangement is called an XYXY arrangement. By taking the XYYX arrangement, inter-electrode capacity between each of the adjacent X electrodes themselves and the Y electrodes themselves can be eliminated, by which generation of ineffective power can be suppressed, as compared with the XYXY arrangement.

The rear substrate 28 has an address electrode 29 (hereafter referred to simply as an A electrode) which intersects at right angles with the X bus electrode 22*b* and the Y bus electrode 23*b* of the front substrate 21, and this A electrode 29 is covered with a dielectric material 30. This A electrode 29 is provided extending in a direction of the arrow mark D1 (row direction) in FIG. 2. On the dielectric material 30, a rib 31 is provided to prevent spread of discharge (to specify discharge region). On the dielectric material 30, a discharge cell DC is provided, which is partitioned by this rib 31. On the discharge cell DC, each of fluorescent material layers 32R, 32G and 32B are coated, which emit red, green and blue light, respectively.

FIG. 3 is a cross-sectional view of an important part of a PDP shown in FIG. 2, viewed from a direction of the arrow mark D2. Reference numeral 33 shows a discharge space filled with discharge gas for generation of plasma. When voltage is applied between electrodes, plasma 10 is generated by ionization of the discharge gas. FIG. 3 shows schematically a generated state of the plasma 10. Ultraviolet rays from this plasma make the fluorescent material layer 32 excited for emission, and the emission from the fluorescent material layer 32 transmits the front substrate 21, and a display view screen is configured by emission from each of the discharge cells.

FIGS. 4A-4C are drawings showing operations in one TV field period required to display one image on the PDP shown in FIG. 2. FIG. 4A is a time chart. As shown in (I), the one TV field period 40 is divided into subfields 41 to 48 having a plurality of different emission frequency. Selection of emission and non-emission by each of the subfields expresses color tone. Each of the subfields is configured by a reset period 49, an address discharge period 50 specifying an emission cell, and a sustained discharge period 51, as shown in (II).

FIG. 4B shows a voltage waveform applied to the A electrode, X electrode and Y electrode, in the address discharge period 50 of FIG. 4A. The waveform 52 shows voltage waveform applied to one A electrode in the address discharge period 50, waveform 53 shows voltage waveform applied to the X electrode, and waveforms 54 and 55 show voltage waveforms applied to the i-th and (i+1)-th Y electrodes, and voltages are designated as Vo, Vi and V2 (V), respectively. In FIG. 4B, width of address voltage pulse applied to the A electrode is shown as $t_a$. According to FIG. 4B, when a scanning pulse 56 is applied to the i-th line of Y electrode, address discharge is generated at a cell positioned at an intersection with the A electrode. In addition, even when the scanning pulse 56 is applied to the No. i line of Y electrode, address discharge is not generated in the case where the A electrode is at the ground potential (GND). In this way, in the address discharge period 50, scanning pulse is applied to the Y electrode once, and at the A electrode, in response to the scanning pulse, an emission cell has V0, and a non-emission cell is at the ground potential. At this discharge cell generated this address discharge, charges generated by discharge are formed on the surface of the dielectric layer covering the A electrode and the protective film. By support of this electric field generated by the charges, ON-OFF of sustained discharge, to be described later, can be controlled. That is, a discharge cell generating address discharge becomes an emission cell, and others become non-emission cells.

FIG. 4C shows voltage pulse applied all at the same time between the X electrode and the Y electrode, which is the sustained discharge electrodes, during the sustained discharge period 51 of FIG. 4A. Voltage waveform 58 is applied to the X electrode, and voltage waveform 59 is applied to the Y electrode. In both cases, by alternating application of pulse with the same polarity and with voltage V3 (V), relative voltage between the X electrode and the Y electrode repeats the inversion. Discharge generated in this period in discharge gas between the X electrode and the Y electrode is called sustained discharge.

It should be noted that in trying to achieve a low power consumption, highly precise and high quality PDP, having brightness and long life assured and enabling stable drive, there is a problem of address discharge characteristics, in particular, address discharge delay. Detail of the address discharge delay will be described later.

Large address discharge delay results in failure in address discharge and makes subsequent sustained discharge impossible, which generates a view screen flicker. Furthermore, drive of a PDP over a prolonged period of time raises also a problem of an increase in address discharge delay (deterioration over time). That is, lighting of a PDP over a prolonged period of time also results in generation of a view screen flicker.

As a method for solving this problem, as shown in JP-A-2002-297091, there has been proposed a PDP with reduced discharge delay, with an electrode arrangement of XYYX-type, and by providing an auxiliary electrode adjacent to the Y electrode, in parallel, on a front plate, and by generation of priming discharge by an in-plane auxiliary electrode at the front plate side. In addition, as shown in JP-A-2003-217458, there has been proposed a PDP with electrode arrangement of XYYX-type for achieving enhancement of emission efficiency in the first discharge region and enhancement of address discharge characteristics in the second region at the same time, and by providing the first discharge region for executing sustained discharge, the second discharge region for executing address discharge, and a gap part connecting both discharge regions, and by execution of address discharge between the Y bus electrode and the address electrode, in the second discharge region partitioned by "rib extending in a row direction and in a line direction".

SUMMARY OF THE INVENTION

However, the PDP shown in JP-A-2002-297091, because it uses an auxiliary electrode, requires an auxiliary electrode material and a member such as a drive circuit for applying voltage to the auxiliary electrode, which results in to increase production cost of the PDP.

In a PDP shown in JP-A-2003-217458, there is no increase in a member like one shown in JP-A-2002-297091, however, because the second discharge region is partitioned in a way to respond to the first discharge region one by one, by "ribs extending in a row direction and in a line direction", a problem is raised in the case where scanning line number increases by making a PDP with higher precision. That is, narrowing each discharge space of the first discharge region for execution of sustained discharge, in response to higher precision, provides difficulty in securing brightness. Alternatively, narrowing of discharge space of the second discharge region results in an elevation of discharge initiation voltage or an increase in discharge delay, and makes it difficult to stabilize the address characteristics.

The present invention has been proposed in view of the above circumstance, and it is an object of the present invention to provide a PDP having stable address discharge characteristics, even in making higher precision.

Explanation will be given on outline of typical ones among the present invention disclosed in the present specification, as follows.

(1) A plasma display apparatus including at least:

a front substrate; a plurality of first electrodes and second electrodes extending in a line direction, in which each two thereof are arranged alternately in a row direction on the front substrate; a dielectric layer covering the first electrode and the second electrode; a back substrate; a plurality of address electrodes extending in the row direction, which are arranged on the back substrate in the line direction opposed to the first electrode and the second electrode; a plurality of first longitudinal ribs extending in the row direction; a plurality of traverse ribs extending in the line direction; a plurality of display discharge cells formed by the first longitudinal ribs and the traverse ribs; a priming discharge region formed between the traverse ribs of the adjacent display discharge cells of the second electrode, among the display discharge cells adjacent in the row direction; a second longitudinal rib extending in the row direction on an extended line of the first longitudinal rib and partitioning the priming discharge region; a third longitudinal rib extending in the row direction and further partitioning between the second longitudinal ribs into two sections; a priming discharge cell formed by the second longitudinal ribs, the third longitudinal ribs and the traverse ribs; and a convex electrode extended from the adjacent two second electrodes to the each separate priming discharge cell, on the side facing each other of the two second electrodes adjacent in the row direction; wherein there is a gap spatially connecting the display discharge cell and the priming discharge cell, between the front substrate and the traverse rib partitioning the display discharge cell and the priming discharge cell, and a sum of a width in the line direction of a region formed by the second longitudinal ribs and the traverse ribs, and a pattern width of the second longitudinal ribs, is larger than a sum of a width in the row direction of a region formed by the second longitudinal ribs and the traverse ribs, and a pattern width of the traverse ribs.

(2) A plasma display apparatus including at least:

a front substrate; a plurality of first electrodes and second electrodes extending in a line direction, in which each two thereof are arranged alternately in a row direction on the front substrate; a dielectric layer covering the first electrode and the second electrode; a back substrate; a plurality of address electrodes extending in the row direction, which are arranged on the back substrate in the line direction opposed to the first electrode and the second electrode; a plurality of first longitudinal ribs extending in the row direction; a plurality of traverse ribs extending in the line direction; a plurality of display discharge cells formed by the first longitudinal ribs and the traverse ribs; a priming discharge region formed between the traverse ribs of the adjacent display discharge cells of the second electrode, among the display discharge cells adjacent in the row direction; a second longitudinal rib extending in the row direction and partitioning the priming discharge region; a priming discharge cell formed by the second longitudinal ribs and the traverse ribs; and a convex electrode extended from the adjacent two second electrodes to the each separate priming discharge cell, on the side facing each other of the two second electrodes adjacent in the row direction; wherein there is a gap spatially connecting the display discharge cell and the priming discharge cell, between the front substrate and the traverse rib partitioning the display discharge cell and the priming discharge cell, and the second longitudinal ribs are not present on an extended line of the first longitudinal ribs.

(3) A plasma display apparatus including at least:

a front substrate; a plurality of first electrodes and second electrodes extending in a line direction, in which each two thereof are arranged alternately in a row direction on the front substrate; a dielectric layer covering the first electrode and the second electrode; a back substrate; a plurality of address electrodes extending in the row direction, which are arranged on the back substrate in the line direction opposed to the first electrode and the second electrode; a plurality of first longitudinal ribs extending in the row direction; a plurality of traverse ribs extending in the line direction; a plurality of display discharge cells formed by the first longitudinal ribs and the traverse ribs; a priming discharge region formed between the traverse ribs of the adjacent display discharge cells of the second electrode, among the display discharge cells adjacent in the row direction; a rib for the priming discharge region, which connects an intersection of the first longitudinal rib and the traverse rib on the priming discharge region side in one the display discharge cell among the display discharge cells sandwiching the priming discharge region and adjacent in the row direction, and an intersection of the first longitudinal rib and the traverse rib on the priming discharge region side in the other the display discharge cell, and extends in a direction different from on the extended line of the first longitudinal rib, and partitions the priming discharge region; a priming discharge cell formed by the rib for priming discharge region and the traverse rib; and a convex electrode extended from the adjacent two second electrodes to the each separate priming discharge cell, on the side facing each other of the two second electrodes adjacent in the row direction; wherein there is a gap spatially connecting the display discharge cell and the priming discharge cell, between the front substrate and the traverse rib partitioning the display discharge cell and the priming discharge cell.

According to application of the present invention, address discharge can be generated stably by priming discharge, even in making higher precision. Therefore, the present invention can provide a low power consumption, highly precise and high quality PDP, having brightness and long life assured and enabling stable drive.

Other objects, features and advantages of the invention will become apparent from the following description of the embodiments of the invention taken in conjunction with the accompanying drawings.

BRIEF DESCRIPTION OF THE DRAWINGS

FIG. 8A is an appearance inside a discharge cell before a life test, and FIG. 8B is an appearance inside a discharge cell after the life test.

FIG. 30A is the case where sizes of an X transparent electrode and a Y transparent electrode are the same, and FIG. 30B is the case where they are different.

FIG. 31A is the case where the display discharge cell is arranged at the same interval in each of a line direction and a row direction, FIG. 31B is the case where the display discharge cell DDC is arranged at a frequency of two in the row direction, and FIG. 31C is the case where the display discharge cell DDC is arranged at a frequency of two in the row direction, and the center of visible emission intensity in each display discharge cell is displaced.

DETAILED DESCRIPTION OF THE EMBODIMENTS

Figure 2:
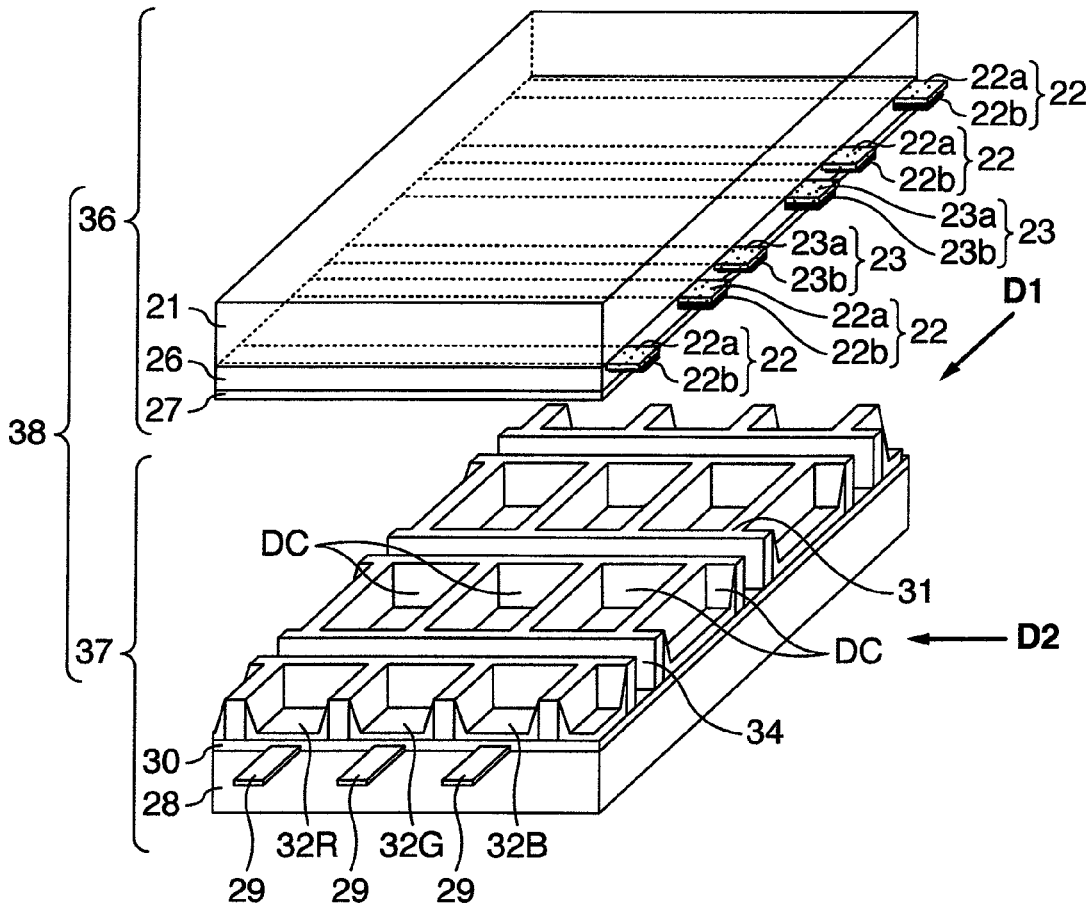
FIG. 2 is a perspective view schematically showing a conventional embodiment.
Figure 3:
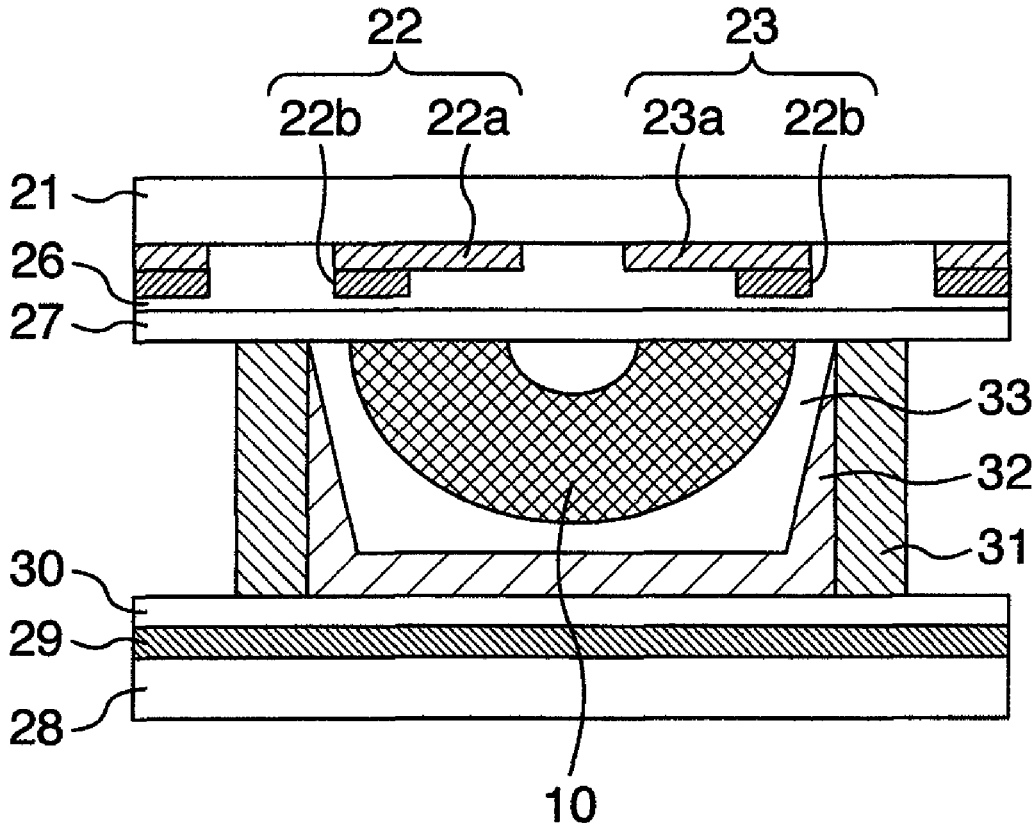
FIG. 3 is a cross-sectional view of the PDP of FIG. 2.
Figure 4A:
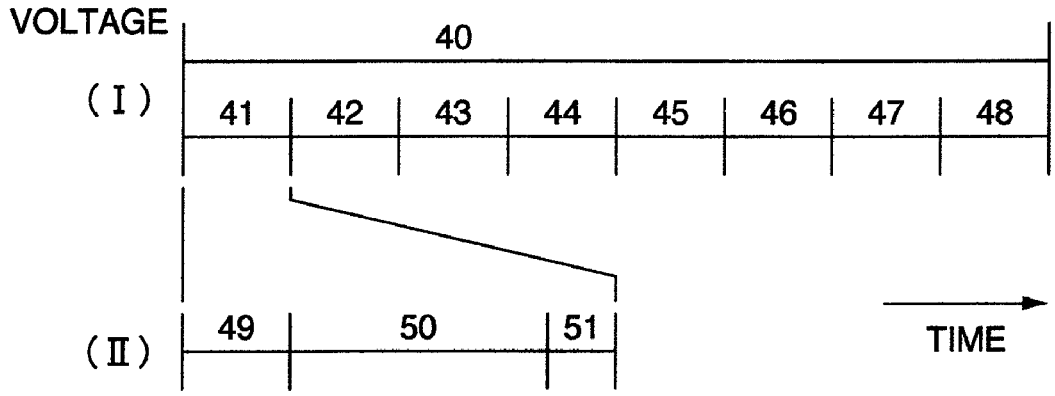
FIGS. 4A-4C are drawings showing operations of one TV field period for displaying one image to a PDP.
Figure 4B:
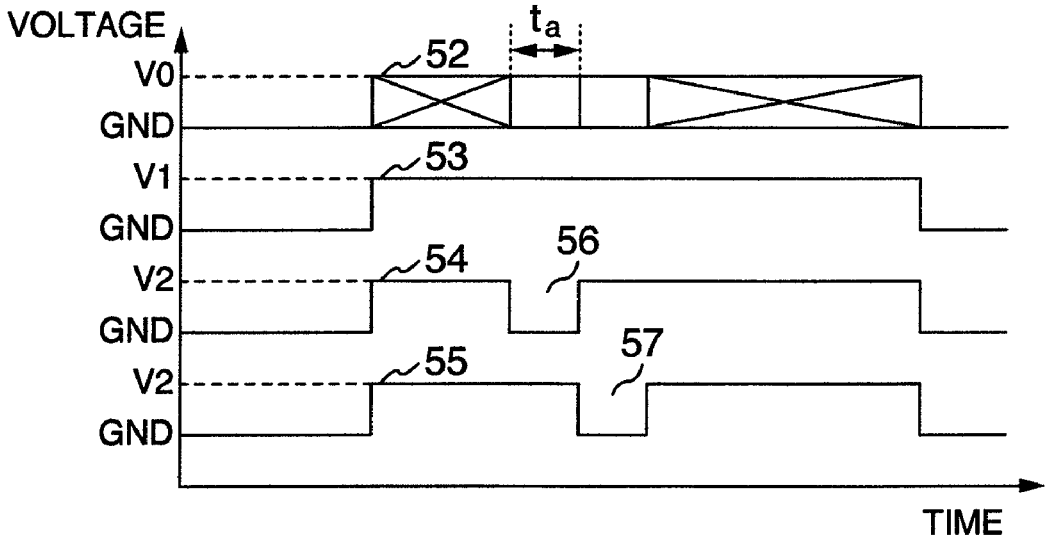
Figure 4C:
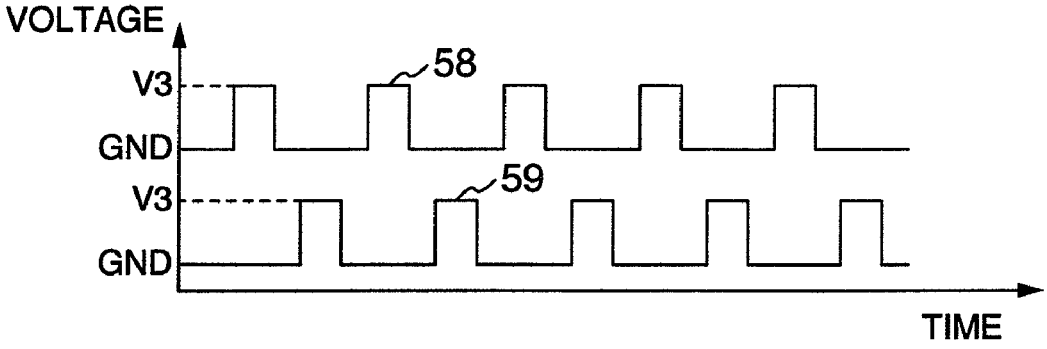

Explanation will be given below in detail on embodiments of the present invention, with reference to drawings. It should be noted that in all drawings for explaining the embodiments, those having the same function have the same reference numeral, to avoid repeated explanation. In addition, also to those having the same function as elements in a conventional embodiment shown in FIG. 2, the same reference numeral is given.

Figure 5:
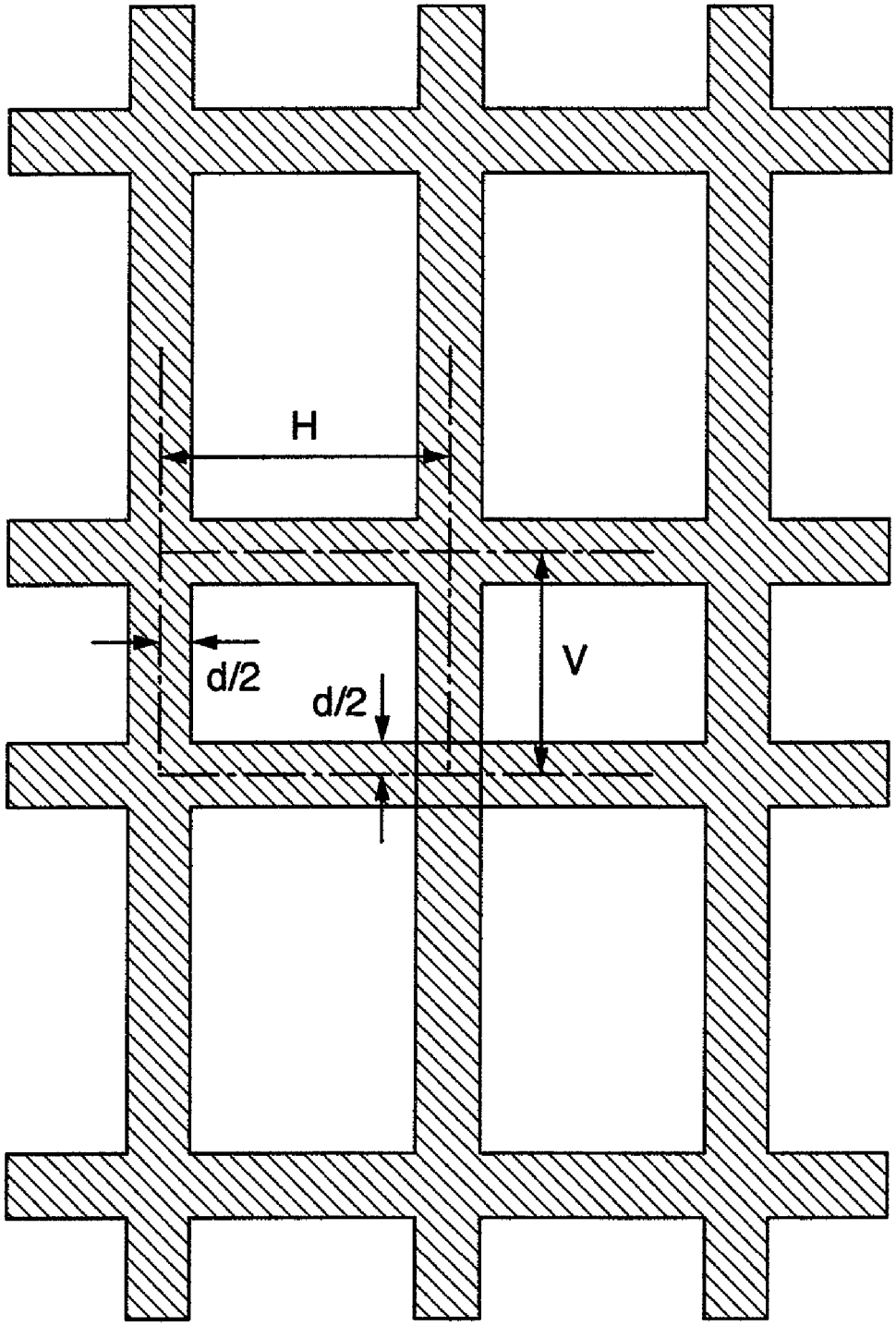
FIG. 5 is a drawing explaining a region examined in proving a proposition.
Figure 6:
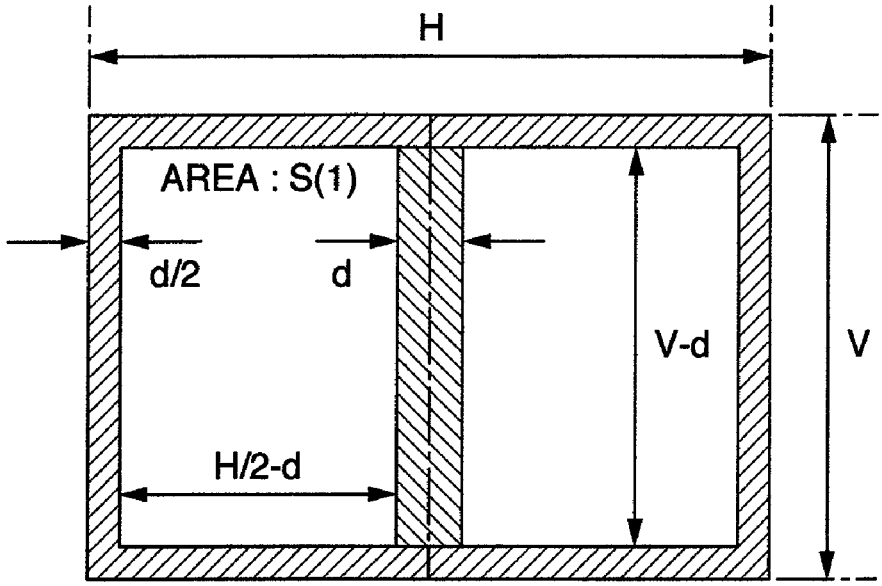
FIG. 6 is an explanation drawing the case where a region examined in proving a proposition is divided by a rib extending in the row direction.
Figure 7:
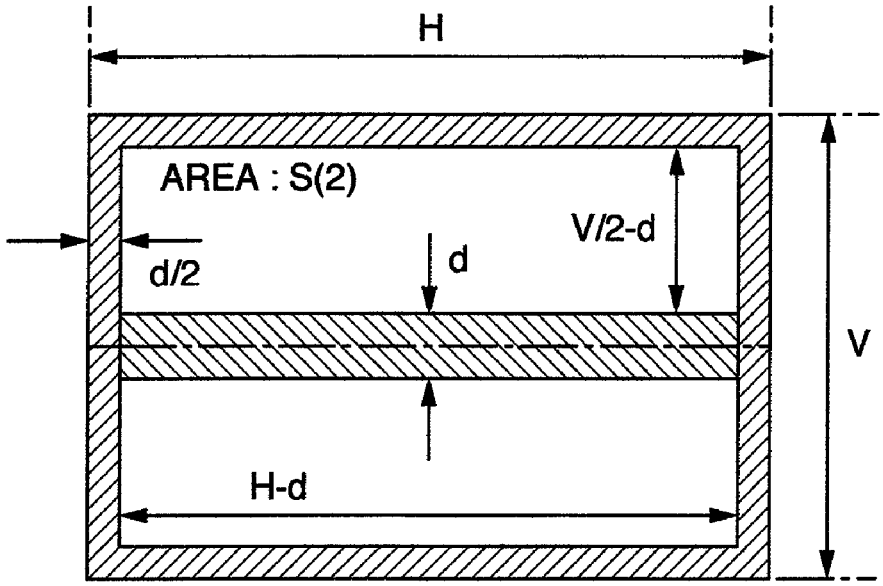
FIG. 7 is an explanation drawing the case where a region examined in proving a proposition is divided by a rib extending in the line direction.

First, by using FIG. 5 to FIG. 7, a proposition relating to the present invention will be proved. The proposition is: "A method is considered for dividing a rectangular region, having a size in a line direction of H, and a size in a row direction of V, surrounded by a rib with a minimal fabrication dimension width of d, into two, by arrangement of a new rib. In this case, to secure wider area of a region not including the rib, obtained by the division, division by a rib extending in a row direction is better than division by a rib extending in a line direction, when [1] H>V. When [2] H<V", division by a rib extending in a line direction is better than division by a rib extending in a row direction.

The proof is as follows. It should be noted that FIG. 5 is a complementary drawing for the proof and to define for division a region surrounded by a rib shown by line and dotted lines. In this case, in consideration of the fact that a rib in a PDP is shared by adjacent regions, a width of circumference ribs present inside the region surrounded by the line and dotted lines is set as d/2.

In addition, in the case of division with a rib extending in a row direction, in FIG. 6, area of regions not containing the rib is not changed, even when this new rib (hatched part) is displaced to any position in a line direction. Therefore the new rib was considered by arranging at the center position in the line direction.

In addition, in the case of division with a rib extending in a line direction, in FIG. 7, area of regions not containing the rib is not changed, even when this new rib (hatched part) is displaced to any position in a row direction. Therefore the new rib was considered by arranging at the center position in the row direction.

First, the case of division with a rib extending in a row direction will be considered. In this case, from FIG. 6, area of a region not including a rib created by partitioning is expressed by the following equation:

$$\begin{aligned} 2\times S(1) &= 2\times\left(\frac{H}{2}-d\right)\times(V-d) \\ &= HV - Hd - 2dV + 2d^2 \end{aligned} \tag{1}$$

On the other hand, in the case of division of a region with a rib extending in a line direction will be considered. In this case, from FIG. 7, area of a region not including a rib created by partitioning is expressed by the following equation:

$$\begin{aligned} 2\times S(2) &= 2\times(H-d)\times\left(\frac{V}{2}-d\right) \\ &= HV - 2Hd - dV + 2d^2 \end{aligned} \tag{2}$$

As a result, it is given:

$$2\times S(1)-2\times S(2)=d\times(H-V) \tag{3}$$

Therefore, from the equation (3), division by a rib extending in a row direction is better than division by a rib extending in a line direction, when [1] H>V. Furthermore, it is understood that division by a rib extending in a line direction is better than division by a rib extending in a row direction, when [2] H<V". As described above, the above proposition has been proved. In addition, it is understood that the above proposition is established irrespective of value of the minimal fabrication dimension width d.

The present proposition will be used in embodiments to be described later, as a basis to show that discharge space can be formed efficiently by partitioning a predetermined space region in a row direction.

When discharge space can be formed widely, the elevation of discharge initiation voltage or the increase in discharge delay can be prevented, and the discharge can be stabilized.

Explanation will be given next on the address discharge delay and deterioration over time of the address discharge delay, which can be improved by the present invention. The address discharge delay $t_d$ is an average period from time when voltage of discharge initiation or higher is applied between electrodes, to time when discharge is formed. In addition, the address discharge delay $t_d$ is divided into a formation delay $t_f$ and a statistic delay $t_s$, and defined as follows:

$$t_d=t_f+t_s \tag{4}$$

wherein, the formation delay $t_f$ is a period from time when seed electrons, which is the start point of discharge, are generated, to time when discharge is formed; the statistic delay $t_s$ is an average period from time when voltage of discharge initiation or higher is applied between the electrodes, to time when the seed electrons are generated. The reason for describing as "average" is that, even when measurements of the period till seed electrons are generated are repeated under the same condition, there exist fluctuation and distribution. The formation delay $t_f$ and the statistic delay $t_s$ are variables necessary to understand the discharge delay phenomenon.

Here, when $t_a$ stands for a width of voltage pulse applied to the address electrode, and when the discharges in a plurality of measurements are not generated all within a time of $t_a$, the address discharge becomes failure, and a display flicker is generated, therefore it is necessary that all discharges occur within the address pulse.

Furthermore, in a life test where a PDP is continuously driven and lightened, the address discharge delay, in particular, the statistic delay largely increases. As a result, all discharges do not fall within the address pulse, generating the display flicker. As described above, the statistic delay is an average period from time when voltage of discharge initiation voltage or higher is applied between the electrodes, to time when the seed electrons are generated. The seed electrons, which are discharge seeds, are generated by that electrons which were captured at trap levels present at places a little lower from the conduction band between the valence band and the conduction band in MgO, are emitted into the discharge space by electric field effect or an Auger process. The electron trapping to the trap levels is executed by irradiation of vacuum ultraviolet rays to MgO, or collision of charged particles to MgO, due to the discharge before the address discharge. Here, because the discharge intensity changes little even after continuous lighting, it is understood that the energy intensity of the vacuum ultraviolet rays or charged particles for capturing electrons at the trap levels, is not necessarily reduced. That is, the reason for the reduction of the number of seed electrons discharged to the discharge space is because of reduction of the number of the trap levels themselves. From the above, it is understood that the reason for the increase in the statistic delay by the life test is the reduction of the number of the trap levels in MgO, and the reduction of the number of seed electrons discharged from MgO.

Figure 8A:
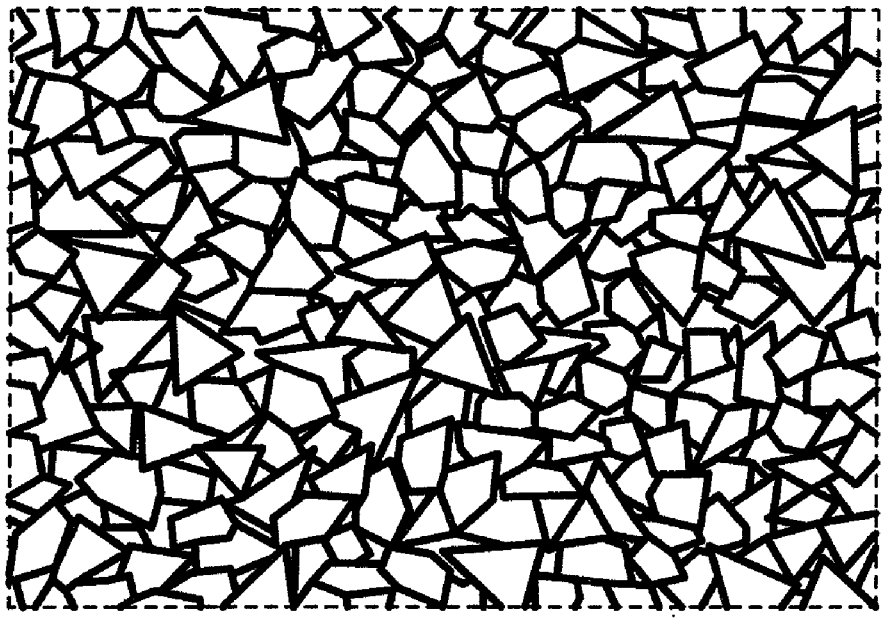
FIGS. 8A and 8B are drawings showing appearance of discharge vestige inside a discharge cell.
Figure 8B:
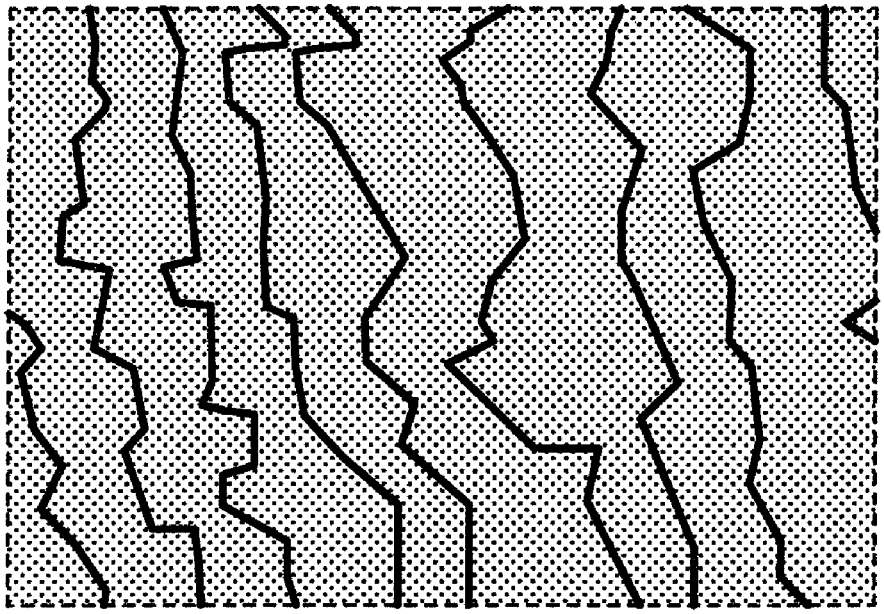

Then, factors inducing the reduction of the number of the trap levels in MgO were investigated. FIG. 8 shows observation result, magnified in 50,000 times, of appearance of MgO surface states before and after the life test. FIG. 8A is an appearance of an MgO surface before the life test, and FIG. 8B is an appearance of a part deteriorated after the life test. It is understood that clear MgO crystallites are left at the surface in FIG. 8A, on the other hand, the surface in FIG. 8B is scale-like and crystallinity is lost. As described above, the trap levels are formed at a little lower from the conduction band of the band structure of the MgO crystal, and it is necessary for MgO to be crystal, for presence of such levels. The reason for losing crystallinity after the life test is because the crystallites are destroyed (sputtered) by collision of ions in plasma to the surface of MgO.

It should be noted that the above discussion was described in the case where a protective film of the front plate dielectric material is MgO. However, because the protective film in a PDP is under environment always receiving the sputter by ions, it is also the case where the protective film is not MgO.

Embodiment 1

Figure 1:
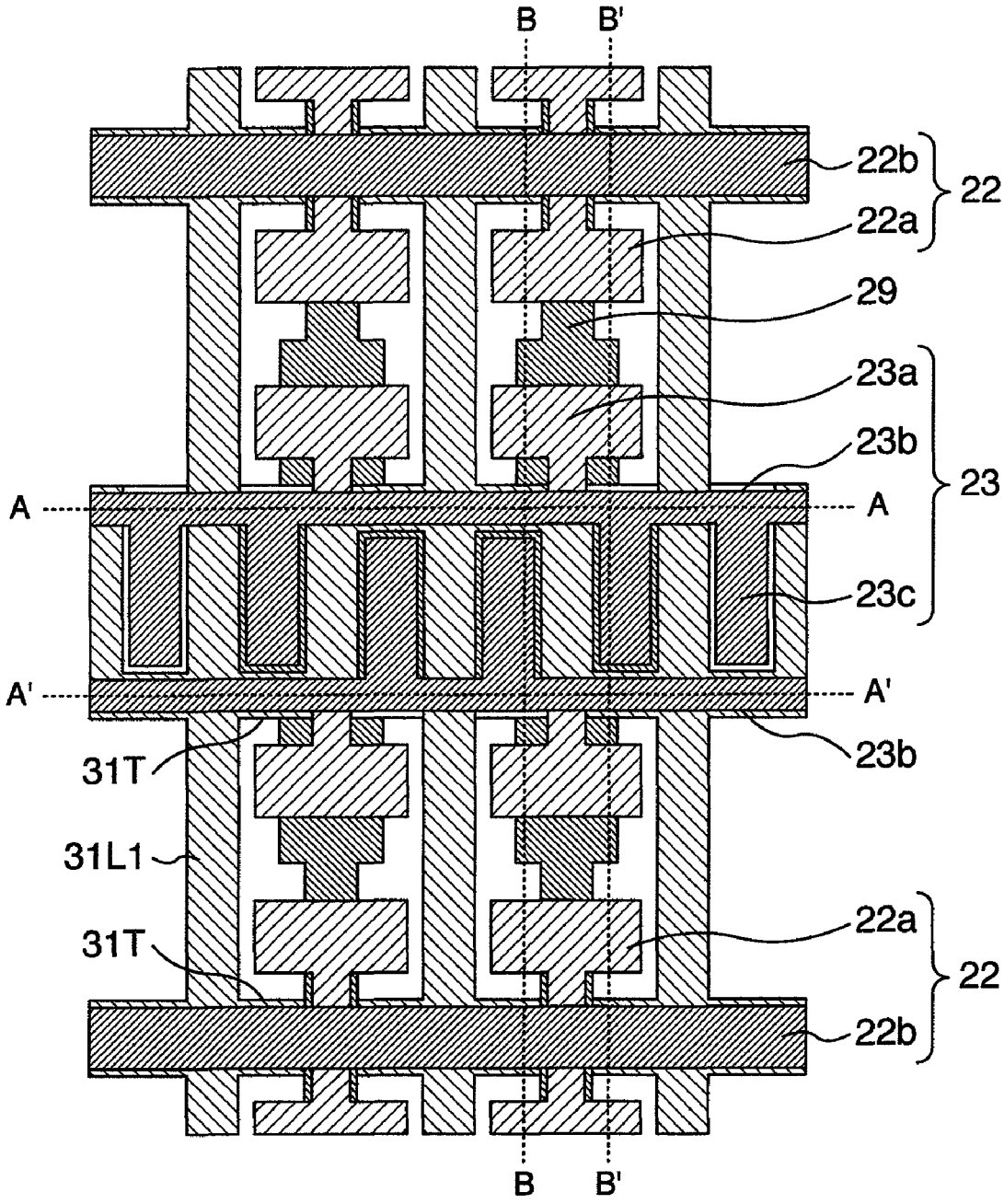
FIG. 1 is a front view schematically showing the first embodiment.
Figure 9:
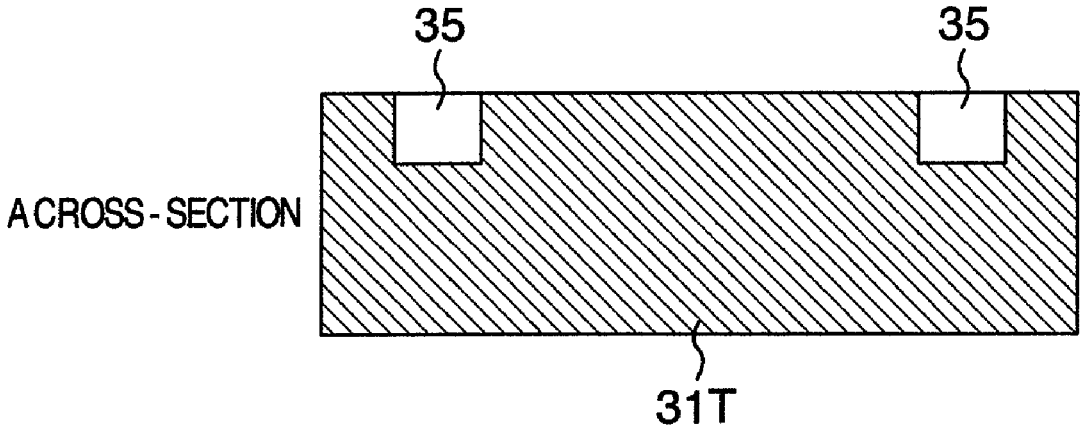
FIG. 9 is a cross-sectional view of the rib along the A line of FIG. 1.
Figure 10:
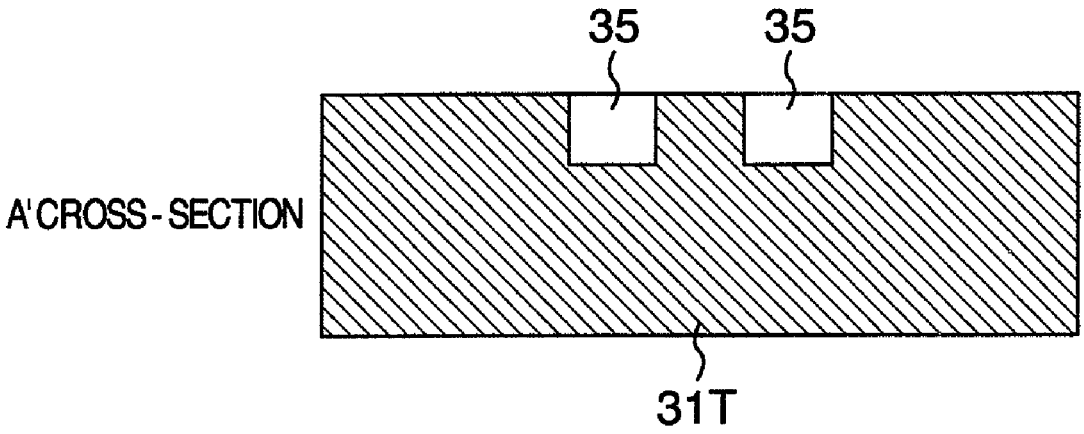
FIG. 10 is a cross-sectional view of the rib along the A' line of FIG. 1.
Figure 11:
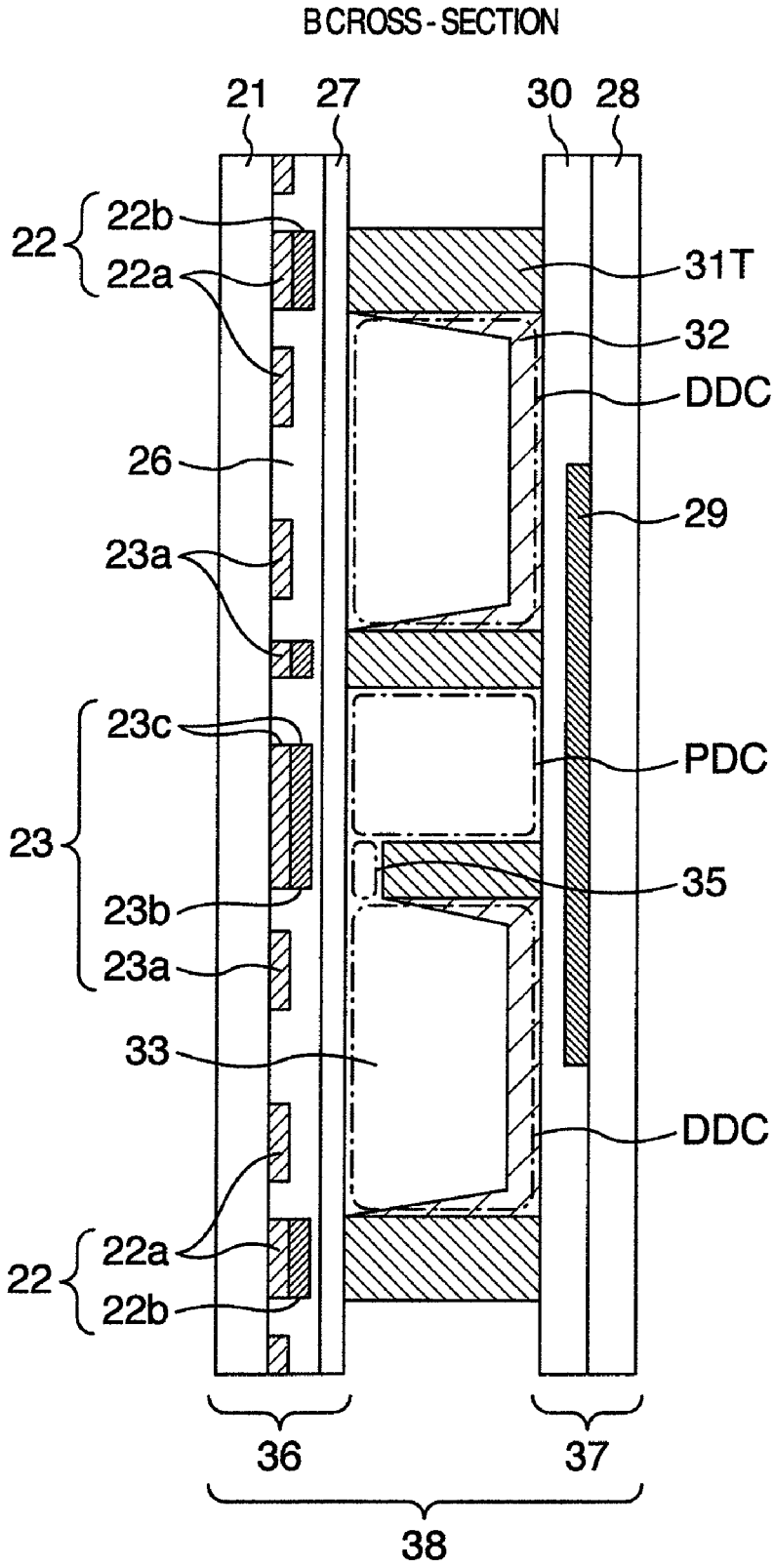
FIG. 11 is a cross-sectional view along the B line of FIG. 1.
Figure 12:
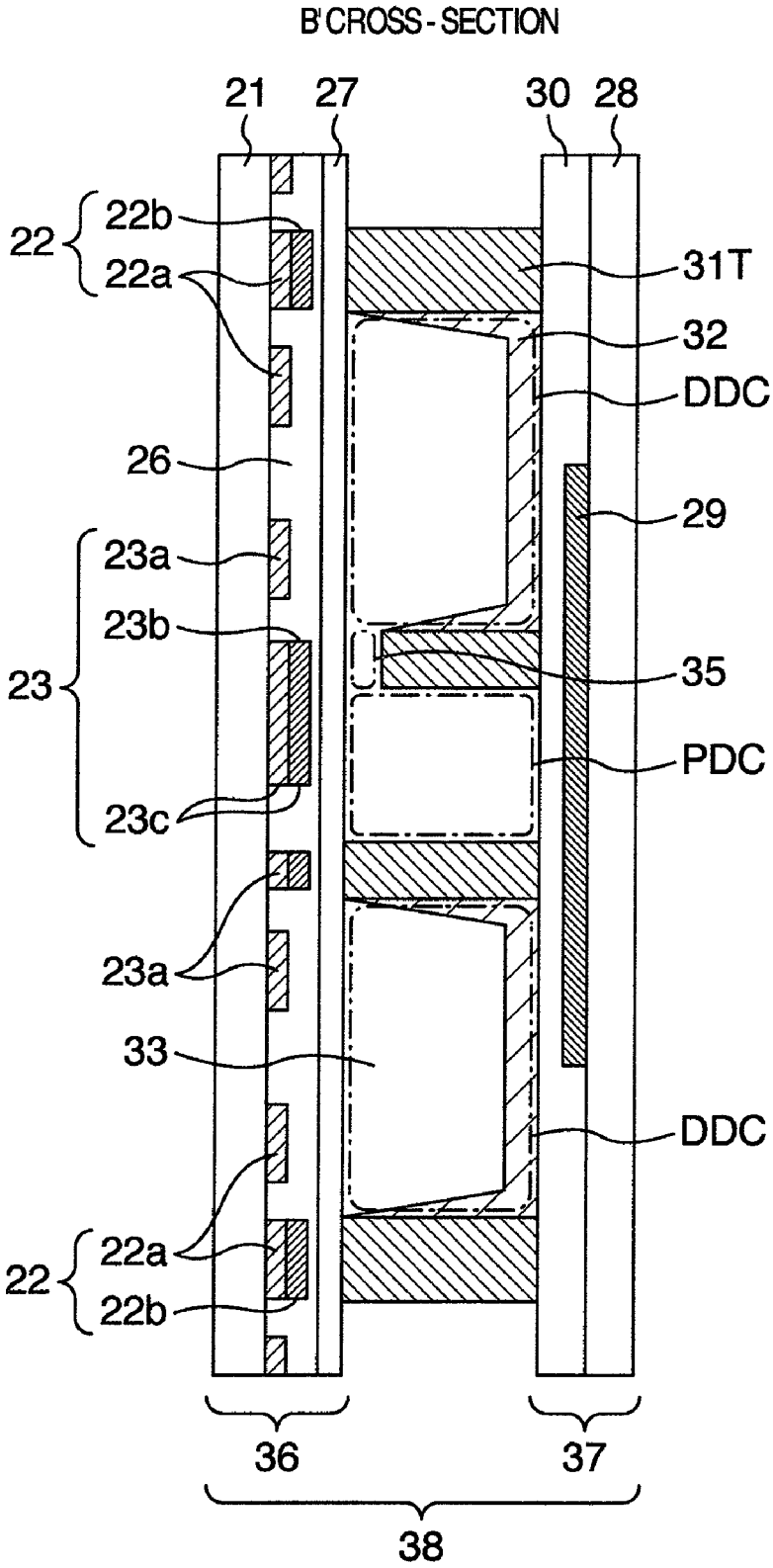
FIG. 12 is a cross-sectional view along the B' line of FIG. 1.
Figure 13:
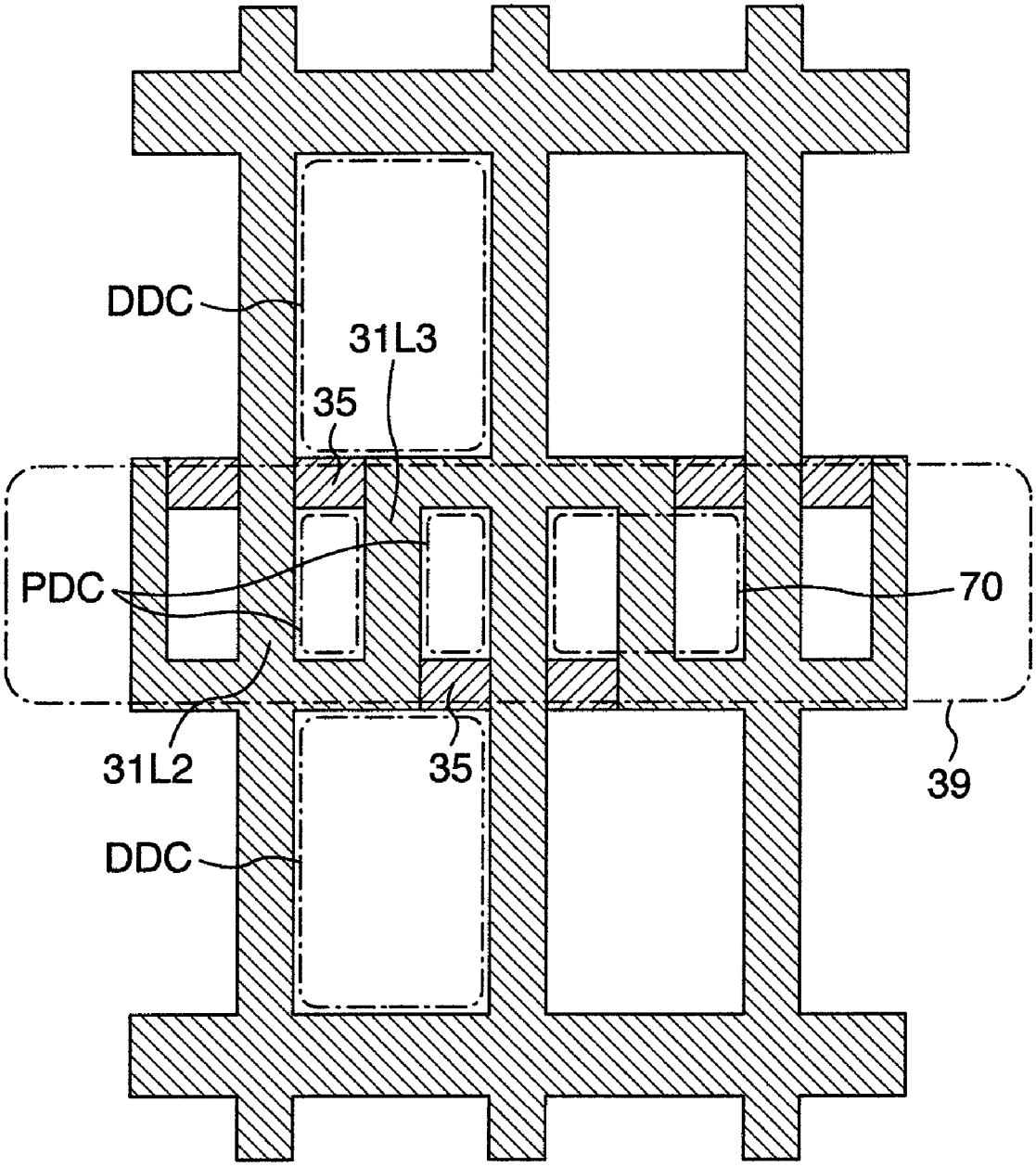
FIG. 13 is a front view schematically showing only the rib structure of FIG. 1.

FIG. 1 and FIG. 9 to FIG. 13 are drawings schematically showing the first embodiment relevant to the present invention; FIG. 1 is a front view showing a part of a PDP cell structure in the first embodiment, FIG. 9 is a cross-sectional view of the rib along the A line of FIG. 1, FIG. 10 is a cross-sectional view of the rib along the A' line of FIG. 1, FIG. 11 is a cross-sectional view along the B line of FIG. 1, FIG. 12 is a cross-sectional view along the B' line of FIG. 1, and FIG. 13 is a front view showing only the rib part of FIG. 1.

(Explanation on the Configuration)

As shown in FIG. 11, in the PDP 38, the front plate 36 composed of the glass front substrate 21 or the like, and the rear plate 37 composed of the glass rear substrate 28 or the like, are arranged in a opposed way, so as to form a discharge space 33, and a circumference part thereof is sealed by using a glass frit (not shown). In the discharge space, discharge gas (mixed gas of Ne and Xe) to generate plasma is encapsulated.

The front substrate 21 has a plurality of sustained discharge electrode pairs formed in parallel, with a constant distance apart. This plural sustained discharge electrode pair is configured by an X electrode 22 (hereafter may also be referred to as X), which is a first electrode, and a Y electrode 23 (hereafter may also be referred to as Y), which is a second electrode. The X electrode 22 is configured by the X transparent electrode 22*a* having T-character shape, and the X bus electrode 22*b* aiming at compensating the electric conductivity of the transparent electrode. In addition, the Y electrode 23 is configured by the Y transparent electrode 23*a* having T-character shape, the Y bus electrode 23*b* aiming at compensating the electric conductivity of the transparent electrode, and a Y convex electrode 23*c*. Explanation will be given later on detailed configuration of the Y convex electrode 23*c*. The X electrode 22 and the Y electrode 23 are provided extending in a line direction. In FIG. 1, each of the sustained discharge electrode pairs takes XYYX arrangement. In addition, in the present embodiment, the two X electrodes adjacent in row direction, are electrically connected to make one X electrode. That is, this one X electrode forms each of the Y electrodes present at both adjacent positions in the row direction and the sustained discharge electrode pairs.

In addition, the X electrode 22 and the Y electrode 23 are covered with the dielectric layer 26 composed of a low melting point glass layer, and this dielectric layer 26 is covered with the protective film 27 composed of MgO.

The rear substrate 28 has an address electrode (hereafter referred to simply as an A electrode) 29, which intersects at right angles with the X electrode 22 and the Y electrode 23 of the front substrate 21, and this A electrode 29 is covered with a dielectric material 30. This A electrode 29 is provided extending in the row direction.

On the dielectric material 30, a rib 31 is provided to prevent spread of discharge (to specify a discharge region). On the dielectric material 30, a display discharge cell DDC having the X electrode 22, the Y electrode 23 and the A electrode 29, along with a priming discharge cell PDC having the Y convex electrode 23*c* and the A electrode 29, are formed by this rib 31. The rib 31 is configured by the first longitudinal rib 31L1 partitioning the display discharge cell DDC by each row, the traverse rib 31T partitioning the display discharge cell by each line, the second longitudinal rib 31L2 partitioning the priming discharge cell PDC, and extending in the row direction on an extension line of the first longitudinal rib 31L1 partitioning the display discharge cell DDC, and the third longitudinal rib 31L3 partitioning the priming discharge cell PDC, and extending in the row direction, not on an extension line of the first longitudinal rib 31L1. It should be noted that the third longitudinal rib 31L3 was arranged so as to be positioned at right the center of the adjacent second longitudinal ribs 31L2 themselves. Therefore, the priming discharge cell PDC is formed by the traverse rib 31T, the second longitudinal rib 31L2 and the third longitudinal rib 31L3. A part between the display discharge cell DDCs themselves arranged in the row direction, sandwiched by the traverse rib 31T, is a priming discharge region 39. In addition, an intersection part of ribs is a common part.

Furthermore, in a region partitioning the display discharge cell DDC and the priming discharge cell PDC, a gap part 35 is formed to spatially connect the display discharge cell DDC and the priming discharge cell PDC. This gap part 35 can be formed by opening a hole into the dielectric material 26 or the protective film 27 at the front substrate 21 side. In the first embodiment, the gap part 35 was formed by altering the height of a rib in a region partitioning the display discharge cell DDC and the priming discharge cell PDC, and that in other regions.

Then, explanation will be given on the configuration of the Y convex electrode 23*c* described above. The Y convex electrode 23*c* is extended from the adjacent Y electrode 23 to the separate priming discharge cell PDC partitioned each by a rib, on the facing sides of two adjacent Y electrodes 23 in the row direction each other. It should be noted that the Y convex electrode 23*c*, in FIG. 11, may be configured by only a transparent electrode. Here, the Y bus electrode 23*b* is arranged in a region sandwiching the traverse rib 31T, facing to the A electrode 29, in a region of the priming discharge cell PDC. The Y electrode 23 may be present at a region sandwiching the display discharge cell DDC. However, arrangement at the position sandwiching the priming discharge cell PDC generates scanning interference and may reduce drive voltage margin, and thus is not desirable.

In addition, the A electrode 29, in the priming discharge region 39, the width in the line direction thereof is designed larger than that in other regions. The other regions mean, for example, parts facing to the X electrode or the Y electrode in the display discharge cell. In this way, a part of an electric field created by the A electrode 29 can compensate a part shielded by the third longitudinal rib 31L3, and the generation of discharge is made easily between the Y convex electrode 23*c* and the A electrode 29 (it should be noted that the shape of the A electrode in the priming discharge cell PDC is similar as in the second embodiment shown in FIG. 21, although it is hidden by a rib in FIG. 1).

Here, in FIG. 1, it was designed so that the sum of the width in the line direction and the pattern width of the second longitudinal rib 31L2 in a nearly rectangular space region 70, containing two priming discharge cells PDCs configured by the second longitudinal rib 31L2 and the traverse rib 31T, is larger than the sum of the width in the row direction and the pattern width of the traverse rib 31T in a space region 70. It should be noted that in the present specification, the pattern width relating to a rib is defined as "the dimension of a position at a height of 90% of distance from the bottom surface".

Therefore, according to the proposition proved above, by partitioning this space region 70 with the third longitudinal rib 31L3 extending in the row direction, a discharge space of the priming discharge cell PDC can be secured efficiently, more stable priming discharge can be executed as compared with a conventional embodiment partitioning with a rib extending in the line direction, and even in making high precision in the row direction (increasing number of the Y electrode 23 for scanning), a PDP excellent in address discharge characteristics can be obtained. In addition, in the case where the width in the row direction of the display discharge cell DDC is required to increase in order to enhance the emission efficiency, reduction of the discharge space in the priming discharge cell PDC can be suppressed, as compared with the case of partitioning in the line direction.

In addition, as shown in FIG. 11, the fluorescent material layer 32 is coated to a display discharge cell DDC, which emits red, green and blue light by ultraviolet rays. (in FIG. 1, the fluorescent material layer 32 is not illustrated).

(Explanation on the Operation)

Explanation will be given in detail next on the drive in the present PDP.

First, in all of the display discharge cells DDCs and all of the priming discharge cells PDCs, by reset the discharge in the reset period, rib charge is formed on the surface of the protective film 27 on the front plate 36 side, and on the surface of the dielectric material 30 and the fluorescent material layer 32 of the rear plate 37.

Explanation will be given next on the operation during the address discharge period. The Y electrode 23 passing the A line in FIG. 1 is defined as the Y electrode (hereafter may also be referred to as the Yi electrode) applied with i-th scanning pulse, and in addition, the Y electrode 23 passing the A' line is defined as the Y electrode (hereafter may also be referred as the Y(i+1) electrode) applied with (i+1)-th scanning pulse.

When a scanning pulse is applied to the Yi electrode, and an address voltage pulse is applied to the A electrode 29, and after elapsing by a certain discharge delay time, in the display discharge cell DDC containing the Yi electrode (in particular, the Y transparent electrode 23*a*) and the A electrode 29, address discharge is generated. On the other hand, when a scanning pulse is applied to the Yi electrode, and an address voltage pulse is applied to the A electrode 29, or after elapsing by a certain discharge delay time, in the priming discharge cell PDC containing the Yi electrode (in particular, the Y convex electrode 23*c*) and the A electrode 29, priming discharge is generated.

In the case where an address discharge in the display discharge cell DDC is generated first, a usual address discharge is generated similarly as in a conventional embodiment. On the other hand, in the case where a priming discharge in the priming discharge cell PDC is generated first, formation of the address discharge in the display discharge cell DDC is promoted, because charged particles such as positive ions or electrons generated by this priming discharge flow into the display discharge cell DDC, which is spatially connected with the priming discharge cell PDC through the gap part 35. That is, in the case where the discharge delay time of the address discharge itself is large, the discharge delay time of the address discharge can be restricted by generation of the priming discharge. This effect can suppress particularly deterioration over time of the address discharge delay (to be described later).

Subsequently, when a scanning pulse is applied to the Y(i+1) electrode, and an address voltage pulse is applied to the A electrode 29, and after elapsing by a certain discharge delay time, in the display discharge cell DDC containing the Y(i+1) electrode (in particular, the Y transparent electrode 23*a*) and the A electrode, an address discharge is generated. On the other hand, when a scanning pulse is applied to the Y(i+1) electrode, and an address voltage pulse is applied to the A electrode 29, or after elapsing by a certain discharge delay time, in the priming discharge cell PDC containing the Y(i+1) electrode (in particular, the Y convex electrode 23*c*) and the A electrode, a priming discharge is generated.

In addition, similarly in the case when the i-th scanning pulse is applied, the discharge delay time of the address discharge can be restricted by generation of the priming discharge.

Here, it never happens that the priming discharge in the priming discharge cell PDC, which is configured by the Yi electrode and the A electrode 29, disturbs the charge state of rib (this is referred to hereafter as "interference of scanning" in the present specification) formed during the reset period, in the priming discharge cell PDC which is configured by the Y(i+1) electrode and the A electrode 29. It is because the Y convex electrode 23*c* of the Yi electrode is not extended to the priming discharge cell PDC configured by the Y(i+1) electrode and the A electrode 29, and also each priming discharge cell PDC is partitioned by the second longitudinal rib 31L2 and the third longitudinal rib 31L3. Therefore, while taking the XYYX arrangement, the priming discharge cell PDC can be configured (in the sense that interference of scanning can be prevented).

The charges generated by the address discharge in the address discharge period are formed on the surface of the dielectric layer 26 and the protective film 27 covering the Y electrode 23.

After this address discharge period, in the sustained discharge period, a voltage pulse is applied between the X electrode 22 and the Y electrode 23 alternately to generate a sustained discharge between the X electrode 22 and the Y electrode 23. Ultraviolet rays from plasma generated by this sustained discharge excite the fluorescent material layers 32 for red, green and blue lights, by which visible emission is obtained, and a display view screen is configured by emission from each of the discharge cells DDCs.

In this time, because the gap part 35 is designed narrow, the sustained discharge seldom spreads to the priming discharge cell PDC. Accordingly, as compared with the protective film 27 inside the display discharge cell, which directly receives sputtering by charged particles, the protective film 27 on the priming discharge cell PDC has smaller sputtered amount in the sustained discharge. Therefore, deteriorated amount of address discharge characteristics (for example, seed electron discharge performance having influence on the display delay time) in the priming discharge cell PDC is extremely small. From the above reason, the present PDP is particularly effective to the problem of deterioration over time, that is, increase in the address discharge delay, caused by the drive of a PDP over a prolonged period of time.

(Experimental Example)

Figure 14:
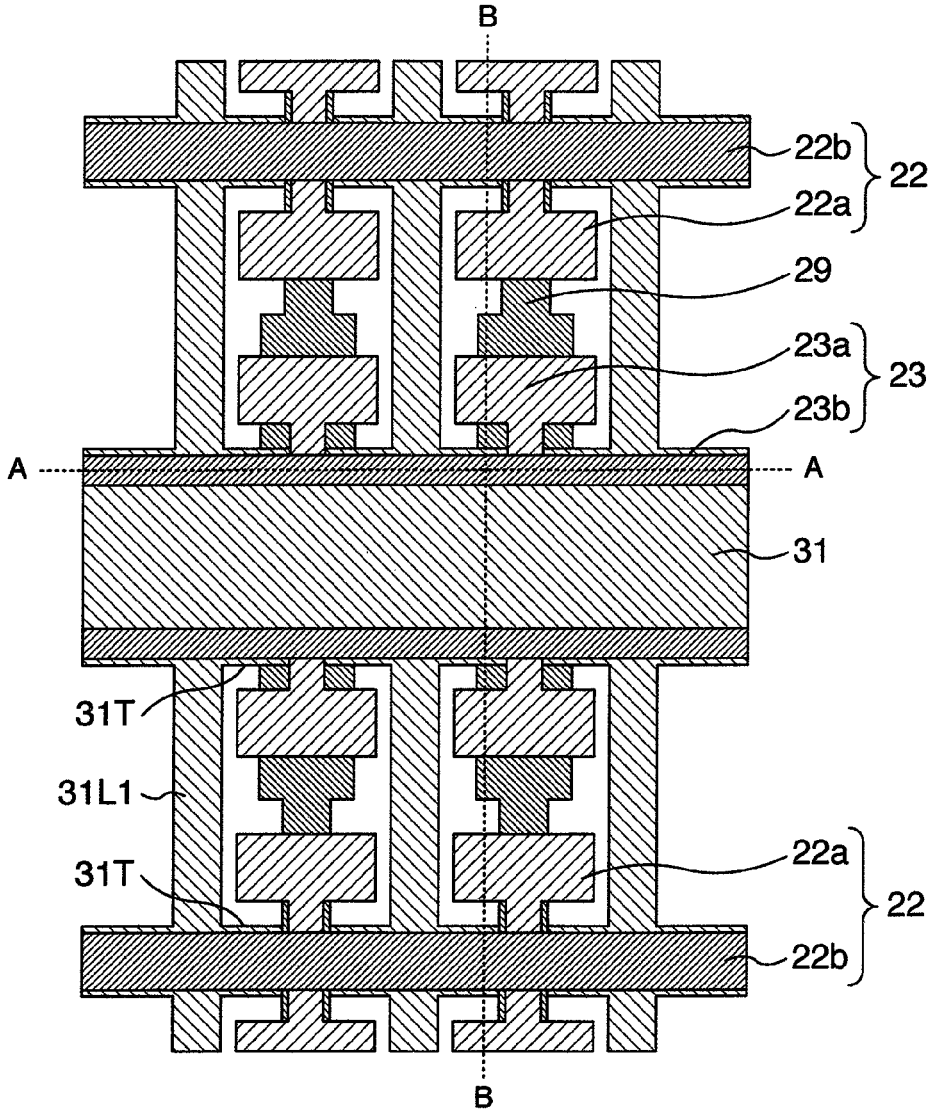
FIG. 14 is a front view schematically showing the structure of "reference" used in an experiment.
Figure 15:
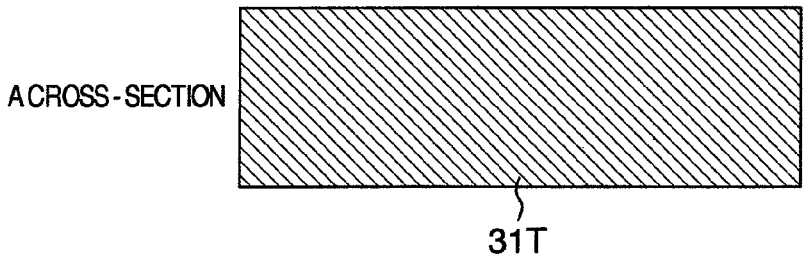
FIG. 15 is a cross-sectional view of the rib along the A line of FIG. 14.
Figure 16:
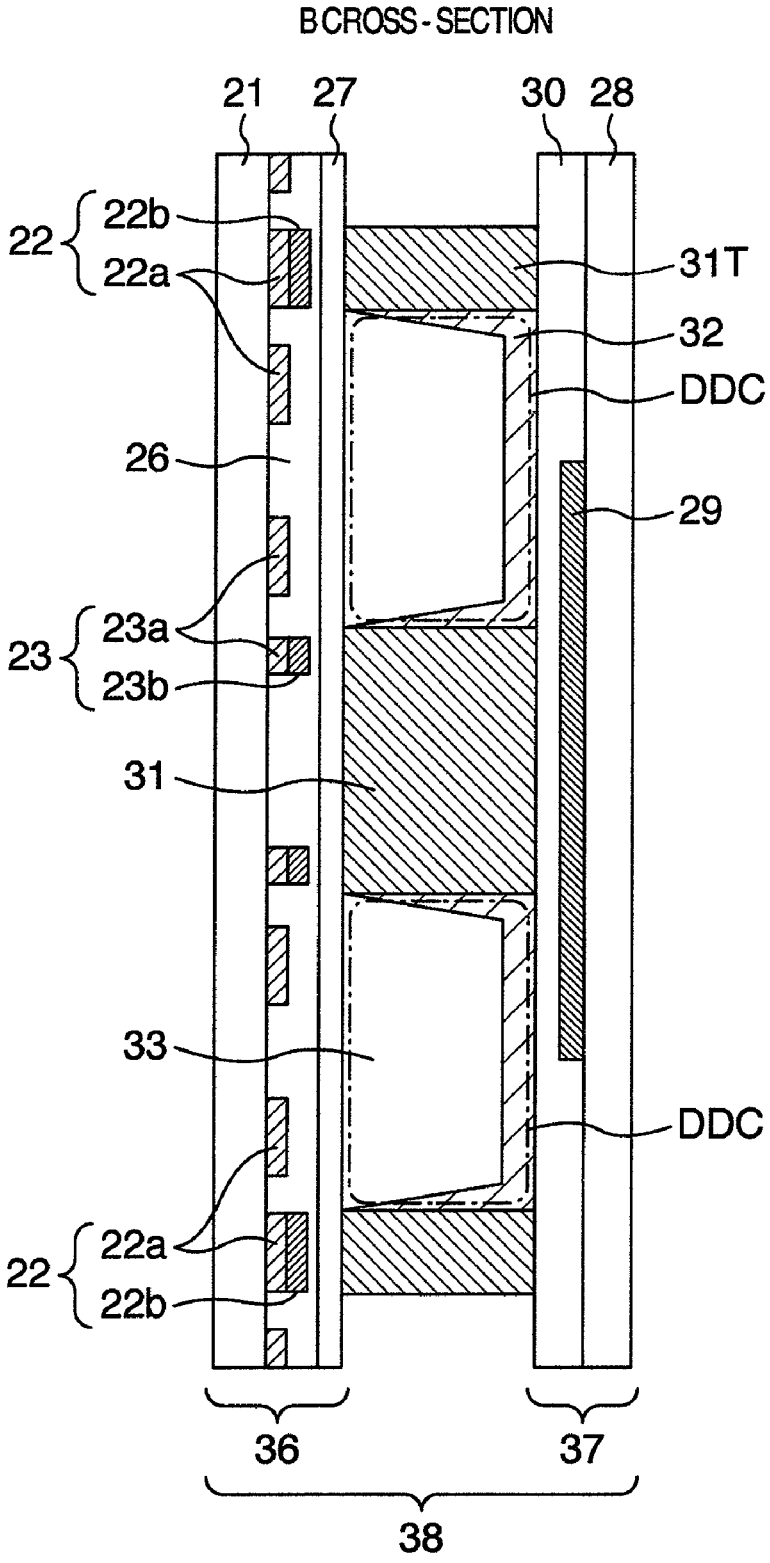
FIG. 16 is a cross-sectional view along the B line of FIG. 14.
Figure 17:
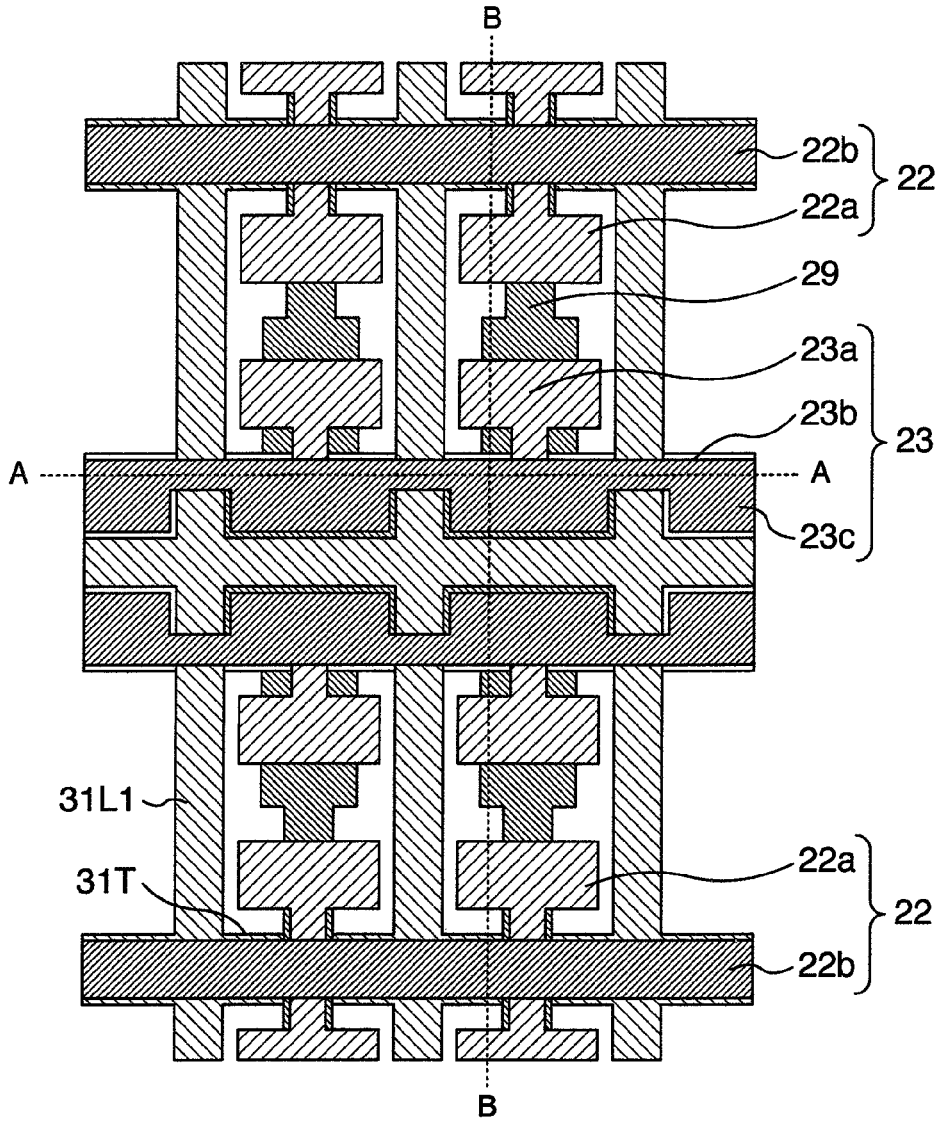
FIG. 17 is a front view schematically showing the structure of "line partitioning type" used in an experiment.
Figure 18:
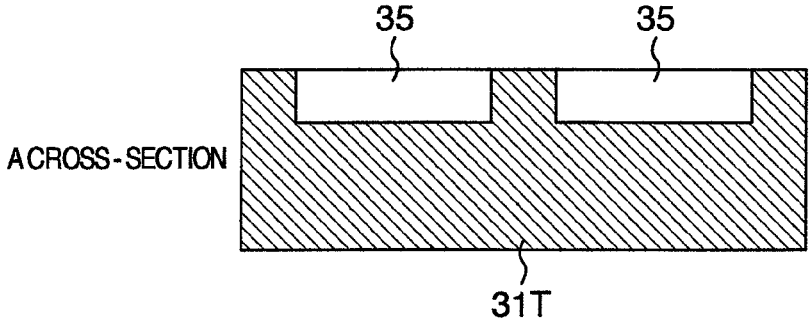
FIG. 18 is a cross-sectional view of the rib along the A line of FIG. 17.
Figure 19:
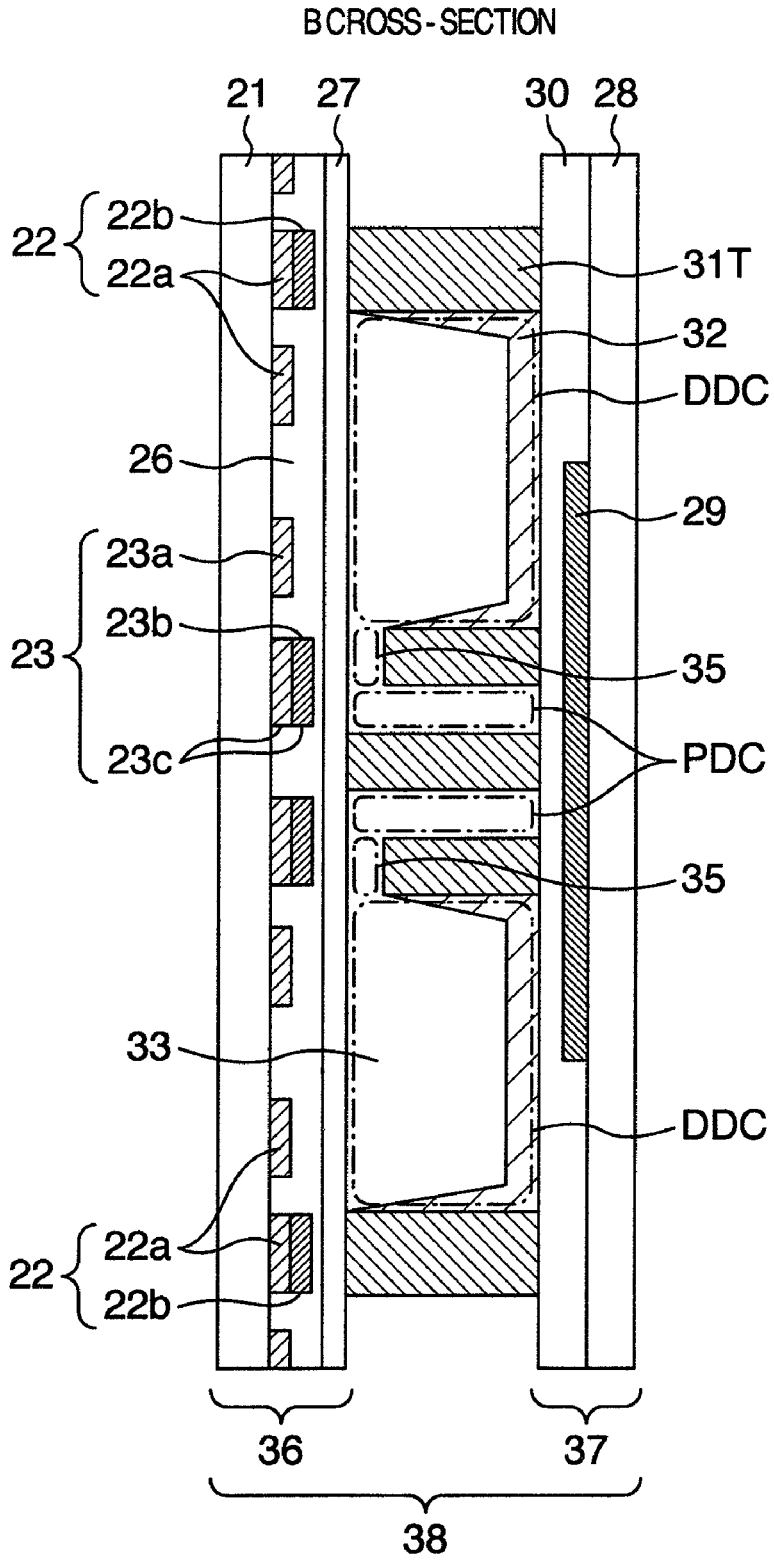
FIG. 19 is a cross-sectional view along the B line of FIG. 17.

A 42-type PDP having a cell structure shown in FIG. 1 (1024 pixels in a traverse direction×1024 pixels in a longitudinal direction) was prepared and evaluated, using two kinds of the next 42-type PDPs (I), and (II), as comparison targets. (I) has a cell structure shown in FIGS. 14, 15 and 16. (I) has the XYYX-type electrode arrangement, and does not have a priming discharge cell PDC. This is called "reference". In addition, (I) has a cell structure shown in FIGS. 17, 18 and 19. (II) has the XYYX-type electrode arrangement, and has the priming discharge cell PDC. It is characterized in that a priming discharge region is partitioned by using a rib extending in the line direction, and by taking this structure and taking the XYYX-type arrangement, scanning interference can be prevented. This structure is called "line partitioning type". In addition, the structure of FIG. 1, as compared with (II), is characterized in that the priming discharge region 39 is partitioned by only a rib extending in the row direction, and also by this structure, scanning interference can be prevented, as described above. This structure is called "row partitioning type".

Figure 20:
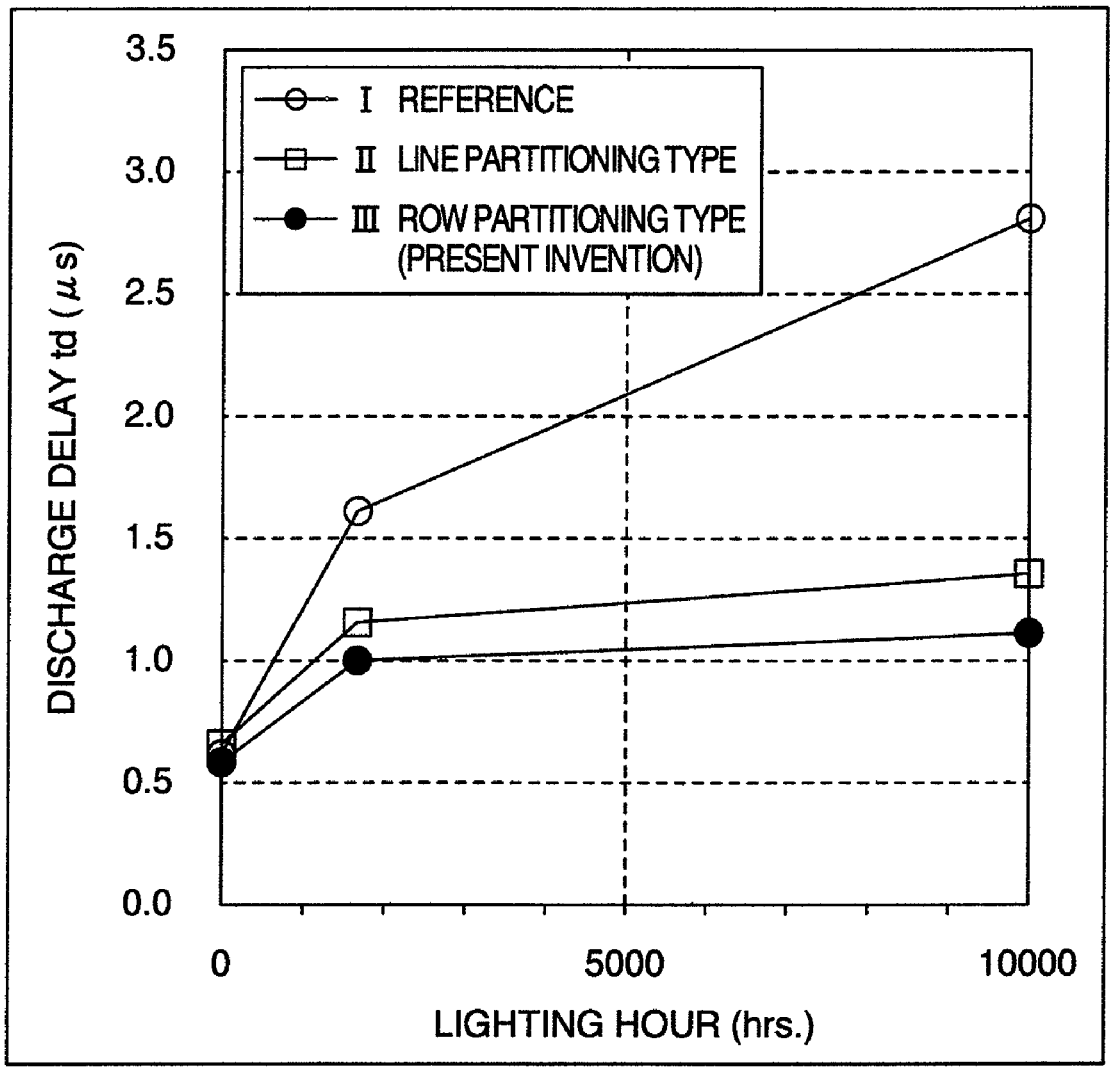
FIG. 20 is a graph showing relationship between lighting time (hrs.) and discharge delay $t_d$ (μs) of each PDP.

In the three kinds of proto-type PDPs of "reference", "line partitioning type" and "row partitioning type", the size of the display discharge cell is the same. In addition, the present proto-type PDPs were prepared to satisfy H>V, by using H and V in the above proposition. As a result, the priming discharge cell of the "row partitioning type" was capable of securing the area 1.25 times the area of the priming discharge cell of the "line partitioning type". Evaluation results of the address discharge delay $t_d$ of PDPs prepared in the present experiment are shown in FIG. 20. Values of $t_d$ at the lighting time in the life test of 1680 hours and 10000 hours were measured. The frequency in the lighting is 12 kHz (a sustained discharge pair is applied 12000 times per second).

From the experimental results shown in FIG. 20, it is understood that the value of $t_d$ increases with lighting time, although it is similar at the initial stage of lighting. In particular, the increasing amount of $t_d$ of "reference" is larger as compared with other two. The reason for this is considered that the MgO protective film 27 in the display discharge cell DDC of "reference" receives sputtering in the discharge with lighting time, resulting in a deterioration of the discharge characteristics such as discharging performance of seed electrons. On the other hand, deterioration over time of $t_d$ of the "line partitioning type" and "row partitioning type" is smaller. In both types of PDPs, the address discharge characteristics of the display discharge cell becomes worse, caused by a deterioration of the MgO protective film performance in the display discharge cell, with lighting time. However, because the priming discharge in the priming discharge cell PDC, as described above, can promote the address discharge of the display discharge cell, along with deterioration over time of the discharge delay $t_d$ of priming discharge is very small, it is considered that the deterioration of $t_d$ in both PDPs becomes small. In addition, when the state after the deterioration over time is compared, $t_d$ in the structure of the present invention ("row partitioning type") is smaller than $t_d$ of the "line partitioning type". The reason is considered that due to the difference of the area of discharge space arisen from the rib formation direction, difference in the discharge formation rate along with the seed electron discharge performance is generated. That is, by using the cell structure of the present invention, address discharge is possible at higher rate, as compared with a conventional structure. This means that a PDP having good address discharge characteristics can be provided, even in making higher precision.

Embodiment 2

Figure 21:
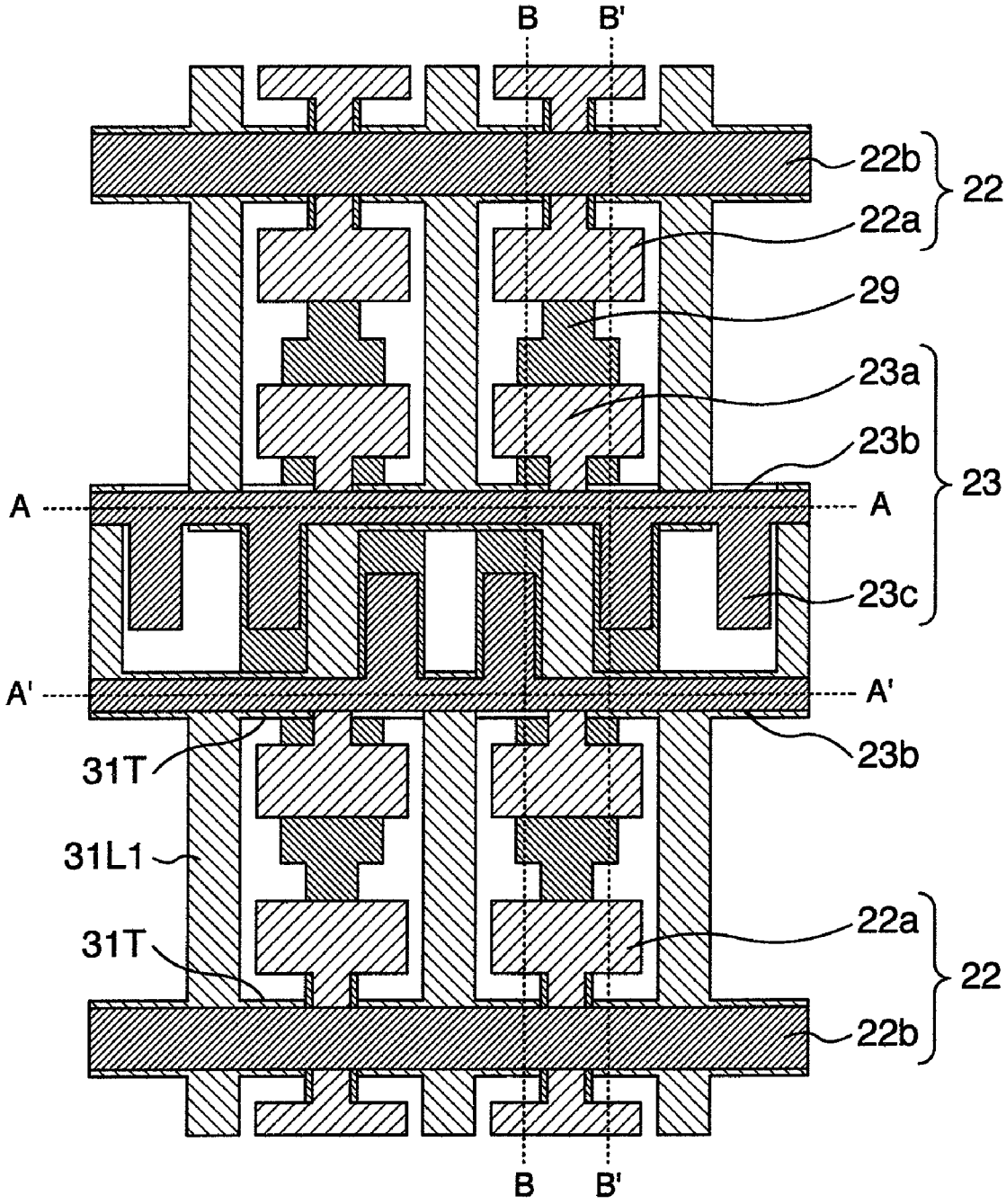
FIG. 21 is a front view schematically showing the second embodiment.
Figure 22:
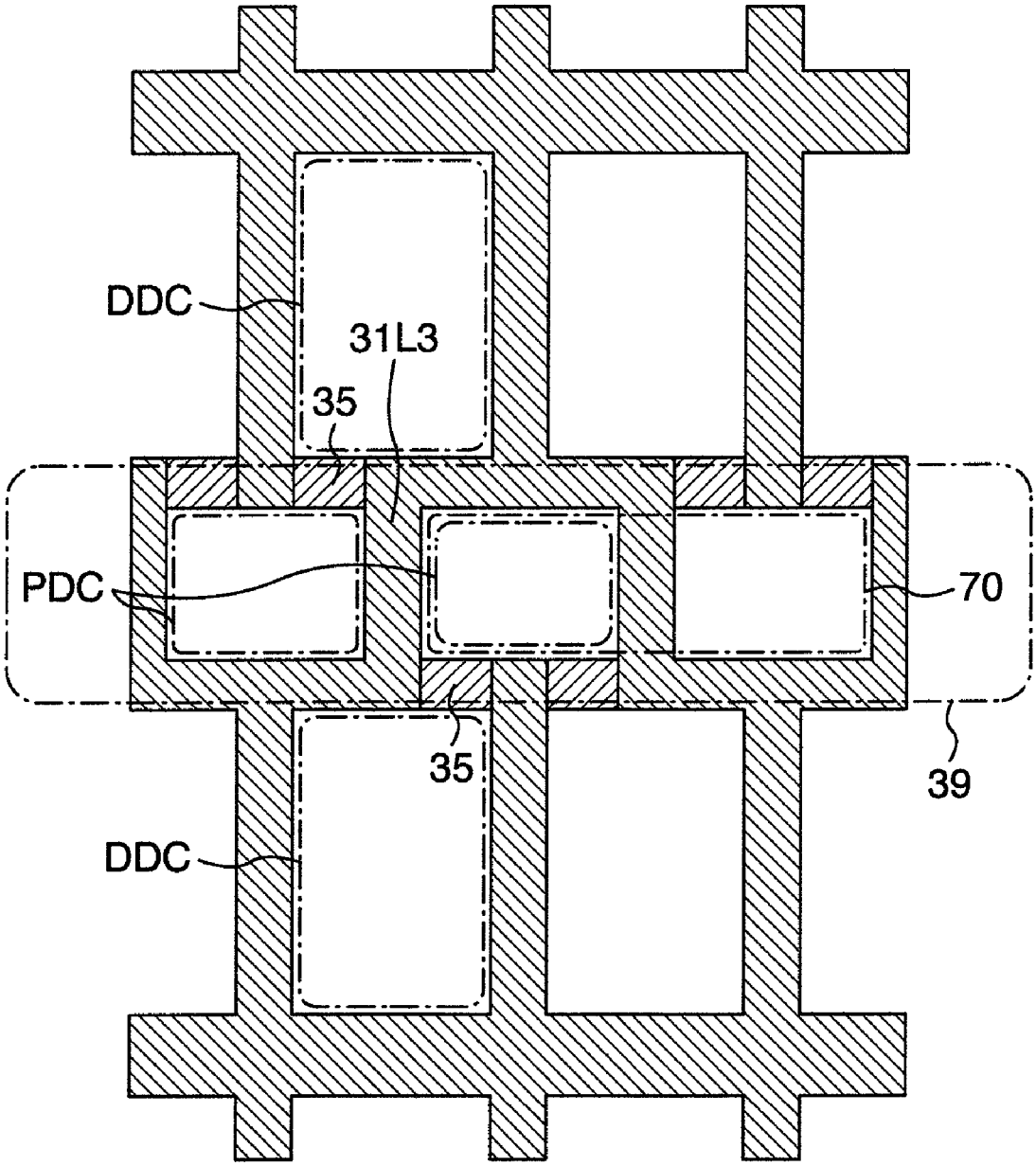
FIG. 22 is a front view schematically showing only the rib structure of FIG. 21.

FIG. 21 and FIG. 22 are drawings schematically showing the second embodiment relevant to the present invention; FIG. 21 is a front view showing a part of a cell structure of PDP in the second embodiment, and FIG. 22 is a front view showing only the rib part of FIG. 21. In addition, the cross-sectional view in each of cross-sections (A cross-section, A' cross-section, B cross-section, and B' cross-section,) of FIG. 21 is similar as in the first embodiment.

(Explanation on the Configuration)

A PDP in this second embodiment has configuration where the second longitudinal rib 31L2 is removed in the priming discharge region 39 arranged with the second longitudinal rib 31L2 and the third longitudinal rib 31L3 in the first embodiment above. That is, two adjacent priming discharge cells PDCs, sandwiching the second longitudinal rib 31L2 in the first embodiment, are combined to achieve single priming discharge cell PDC.

By taking such a configuration, space per priming discharge cell PDC can be broadened. Therefore, because the ratio of suppression of discharge formation caused by collision of charged particles generated at the discharge formation to the rib wall surface, can be reduced, the address discharge characteristics can be enhanced further, as compared with the first embodiment. In addition, the advantage includes reduction of parts number, corresponding to the elimination of the second longitudinal rib 31L2, as compared with the first embodiment. Furthermore the advantages include enabling reduction of electrostatic capacitance between the electrodes, reduction of useless power consumption, and enhancement of the response of drive control, by replacing general low melting point glass as a rib material with discharge gas having low dielectric constant.

Here, in FIG. 22, it is designed so that the sum of the width in the line direction and the pattern width of the third longitudinal rib 31L3 in a nearly rectangular space region 70 containing two priming discharge cells PDCs configured by the third longitudinal rib 31L3 and the traverse rib 31T, is larger than the sum of the width in the row direction and the pattern width of the traverse rib 31T in a space region 70. Accordingly, similarly as in the case of the first embodiment, also in the second embodiment, when the space region 70 is taken as in FIG. 22, wider space of the priming discharge cell PDC can be secured, by partitioning the space region 70 with the third longitudinal rib 31L3 extending in the row direction, than partitioning it by using a rib extending in the line direction.

Other configurations and drive motion are similar as in the PDP shown in the first embodiment described above.

Embodiment 3

Figure 23:
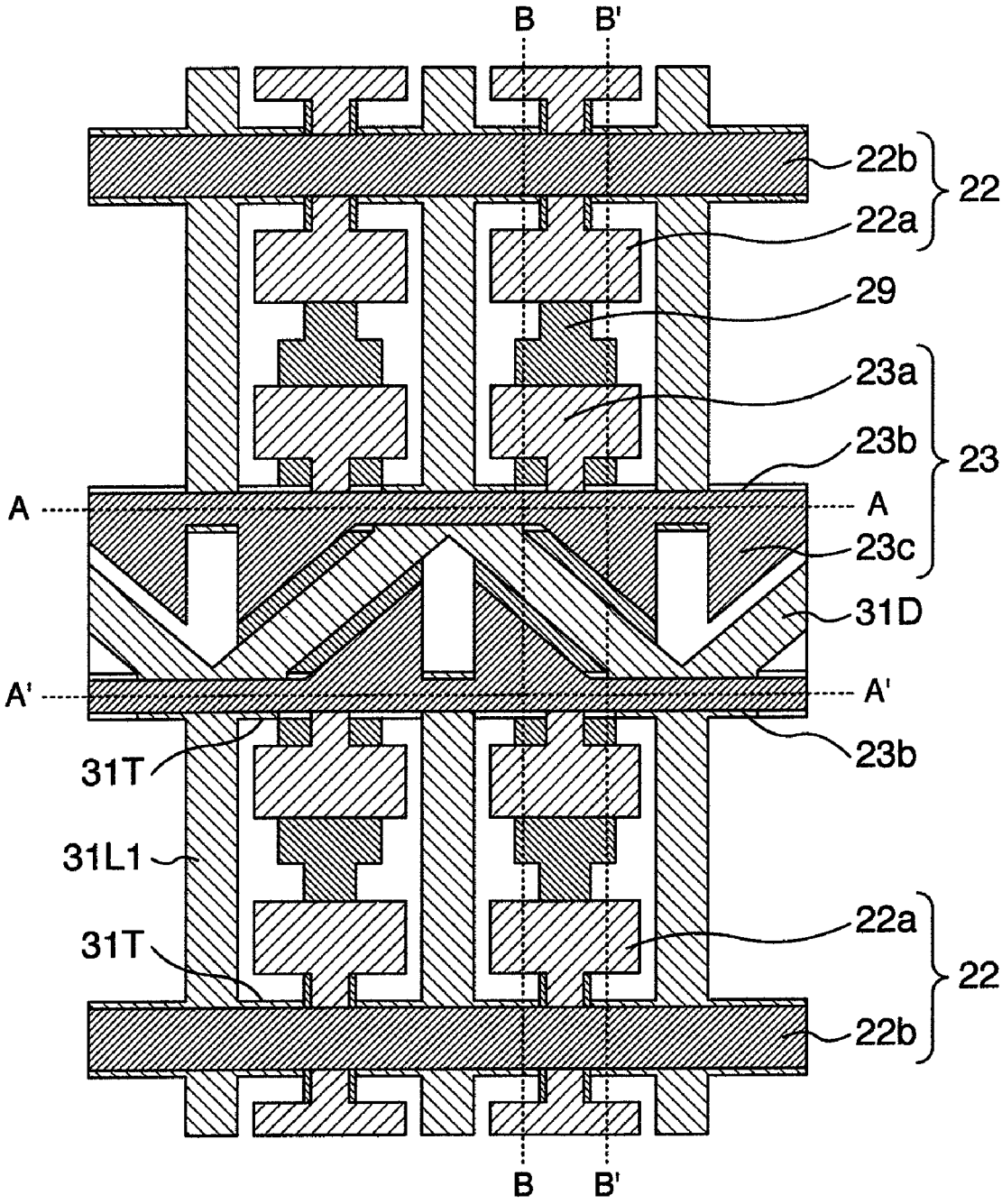
FIG. 23 is a front view schematically showing the third embodiment.
Figure 24:
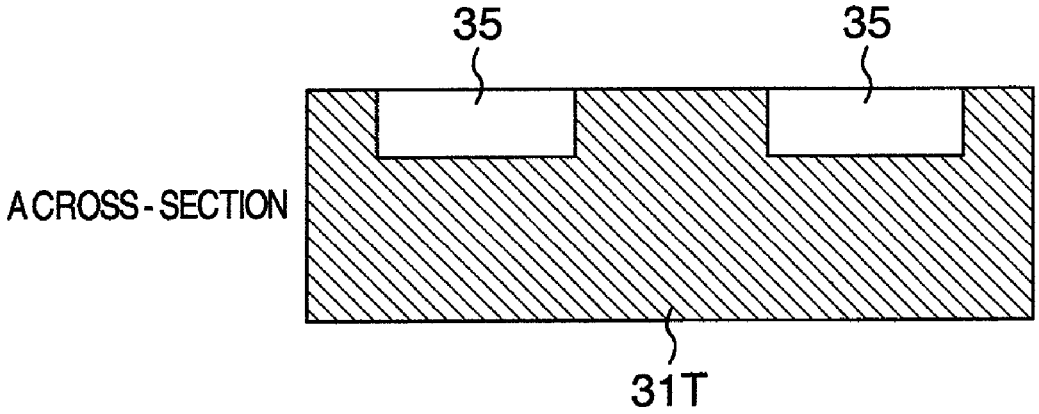
FIG. 24 is a cross-sectional view of the rib along the A line of FIG. 23.
Figure 25:
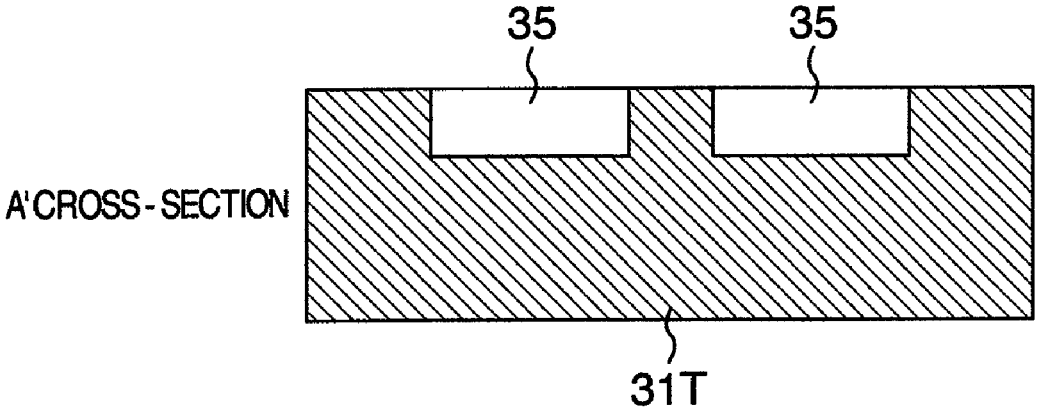
FIG. 25 is a cross-sectional view of the rib along the A' line of FIG. 23.
Figure 26:
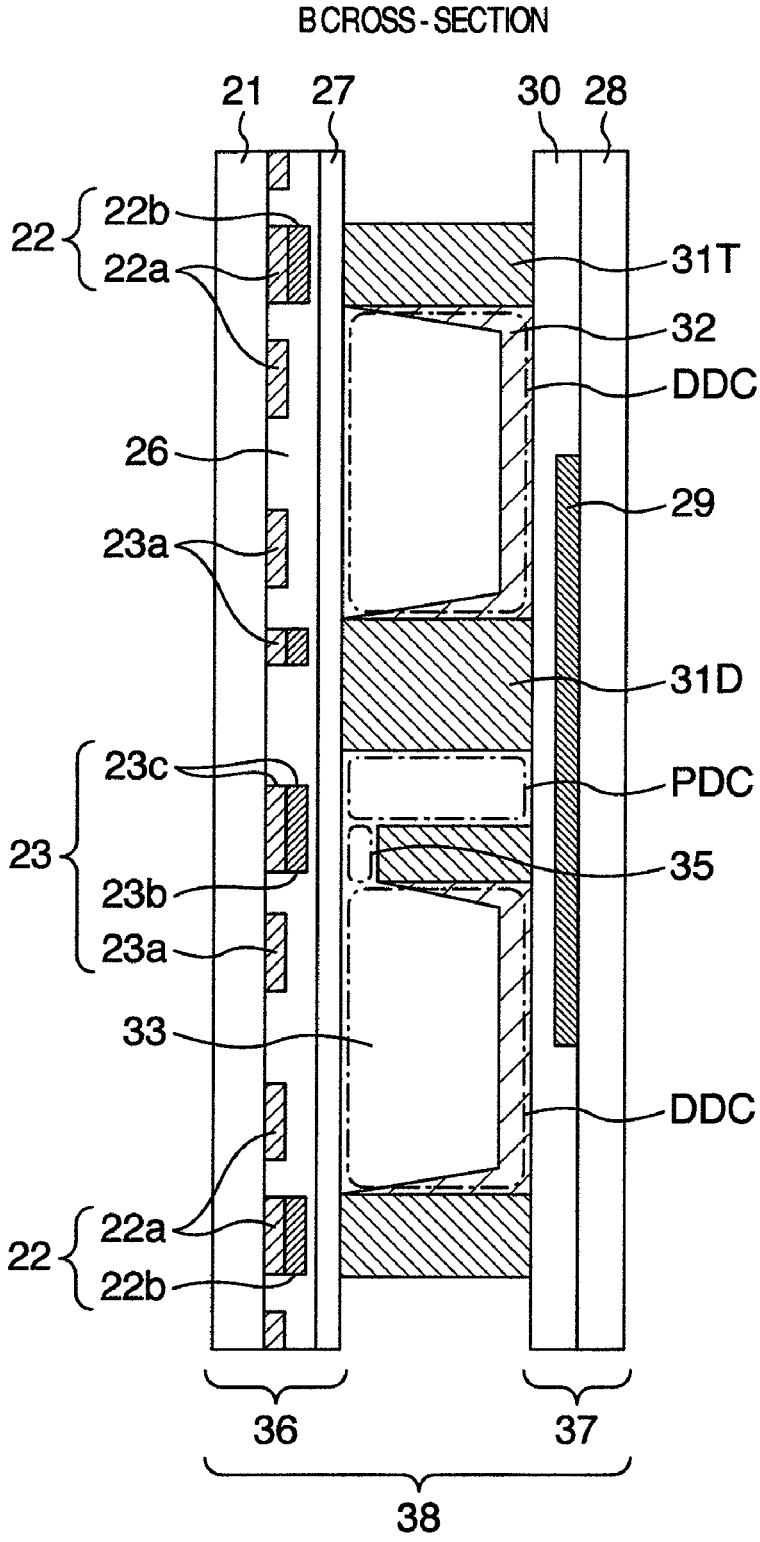
FIG. 26 is a cross-sectional view along the B line of FIG. 23.
Figure 27:
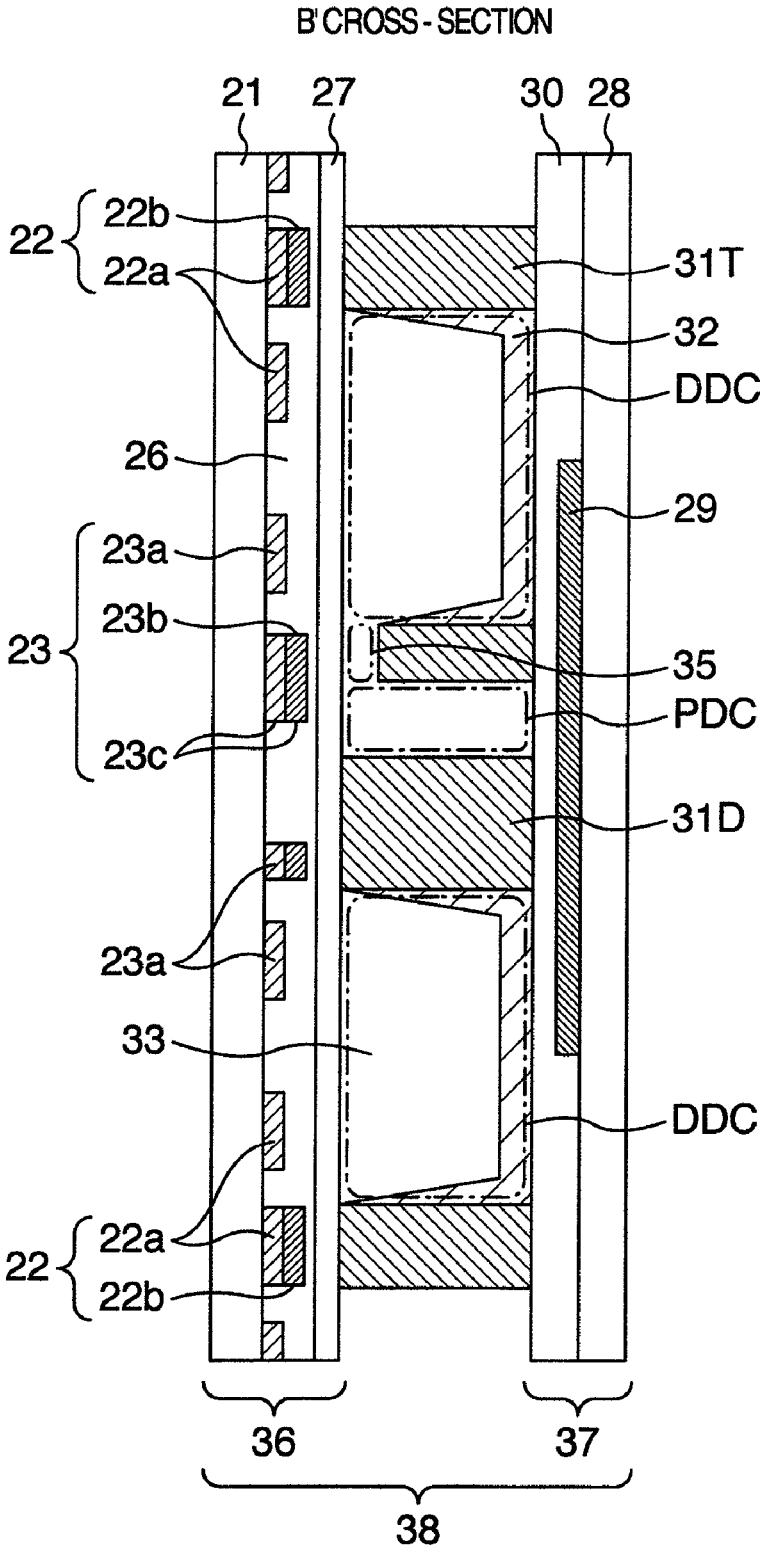
FIG. 27 is a cross-sectional view along the B' line of FIG. 23.

FIG. 23 to FIG. 27 are drawings schematically showing the third embodiment relevant to the present invention; FIG. 23 is a front view showing a part of a PDP cell structure in the third embodiment, FIG. 24 is a cross-sectional view of the rib along the A line of FIG. 23, FIG. 25 is a cross-sectional view of the rib along the A' line of FIG. 23, FIG. 26 is a cross-sectional view along the B line of FIG. 23, and FIG. 27 is a cross-sectional view along the B' line of FIG. 23.

(Explanation on the Configuration)

A PDP in this third embodiment has a configuration where a declined rib 31D is arranged, so as to alternately connect each of an intersection of the first longitudinal rib 31L1 and the traverse rib 31T on the A line, and an intersection of the first longitudinal rib 31L1 and the traverse rib 31T on the A' line, by elimination of the second longitudinal rib 31L2 and the third longitudinal rib 31L3 in the priming discharge region 39, wherein the second longitudinal rib 31L2 and the third longitudinal rib 31L3 were arranged in the first embodiment above. In addition by elimination of the second longitudinal rib 31L2, there are present two display discharge cells connected via the gap part 35 with single priming discharge cell PDC.

By taking such a configuration, space per priming discharge cell PDC can be broadened. Therefore, the ratio of the suppression of discharge formation caused by collision of charged particles generated at the discharge formation to the rib wall surface, can be reduced. Because the gap part 35 can take wide space in the line direction and charged particles can travel to the display discharge cell DDC more efficiently as compared with the first and the second embodiments, the address discharge delay can be reduced.

Other configurations and the drive operation are similar as in the PDP shown in the first embodiment described above.

Embodiment 4

Figure 28:
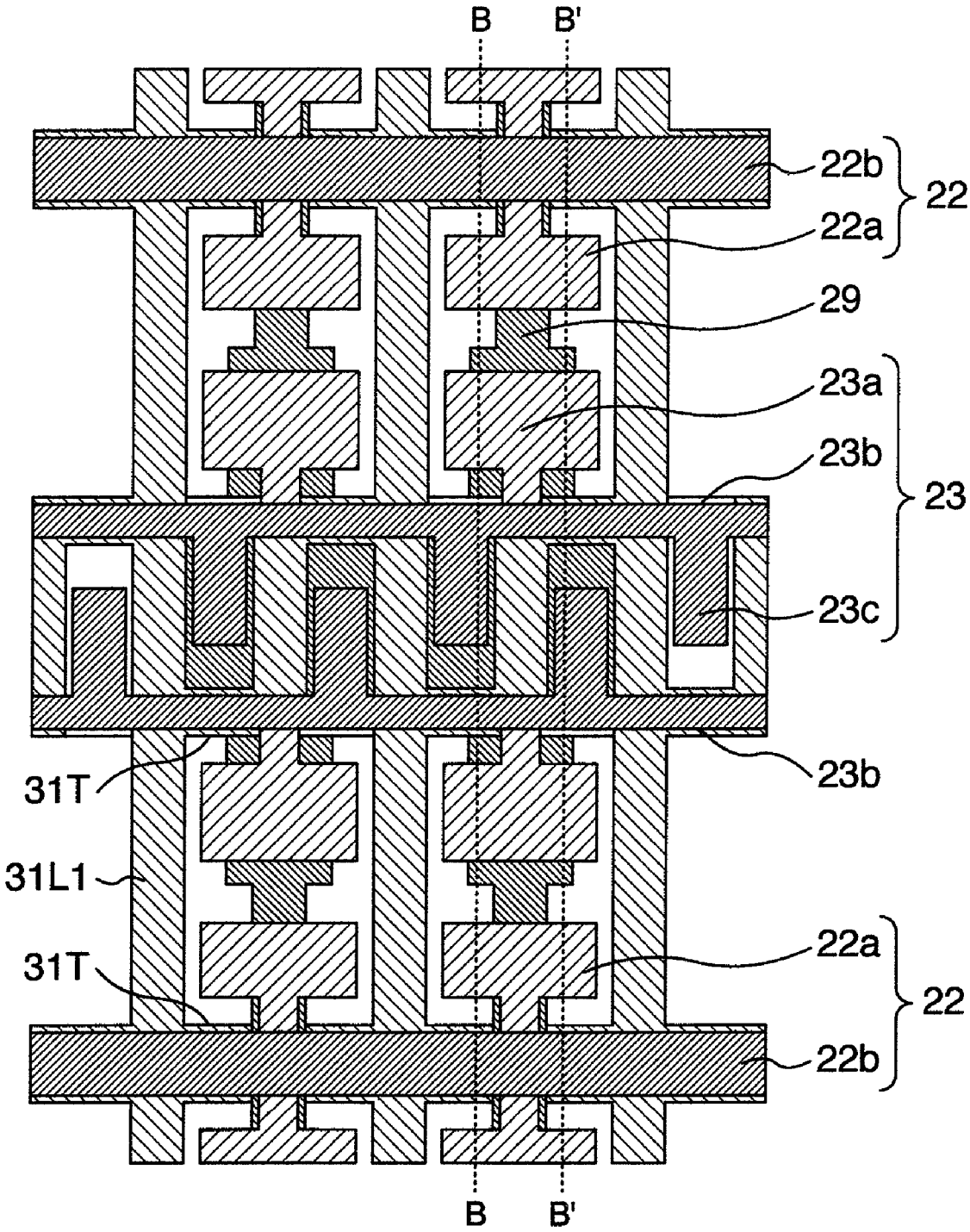
FIG. 28 is a front view schematically showing the fourth embodiment.
Figure 29:
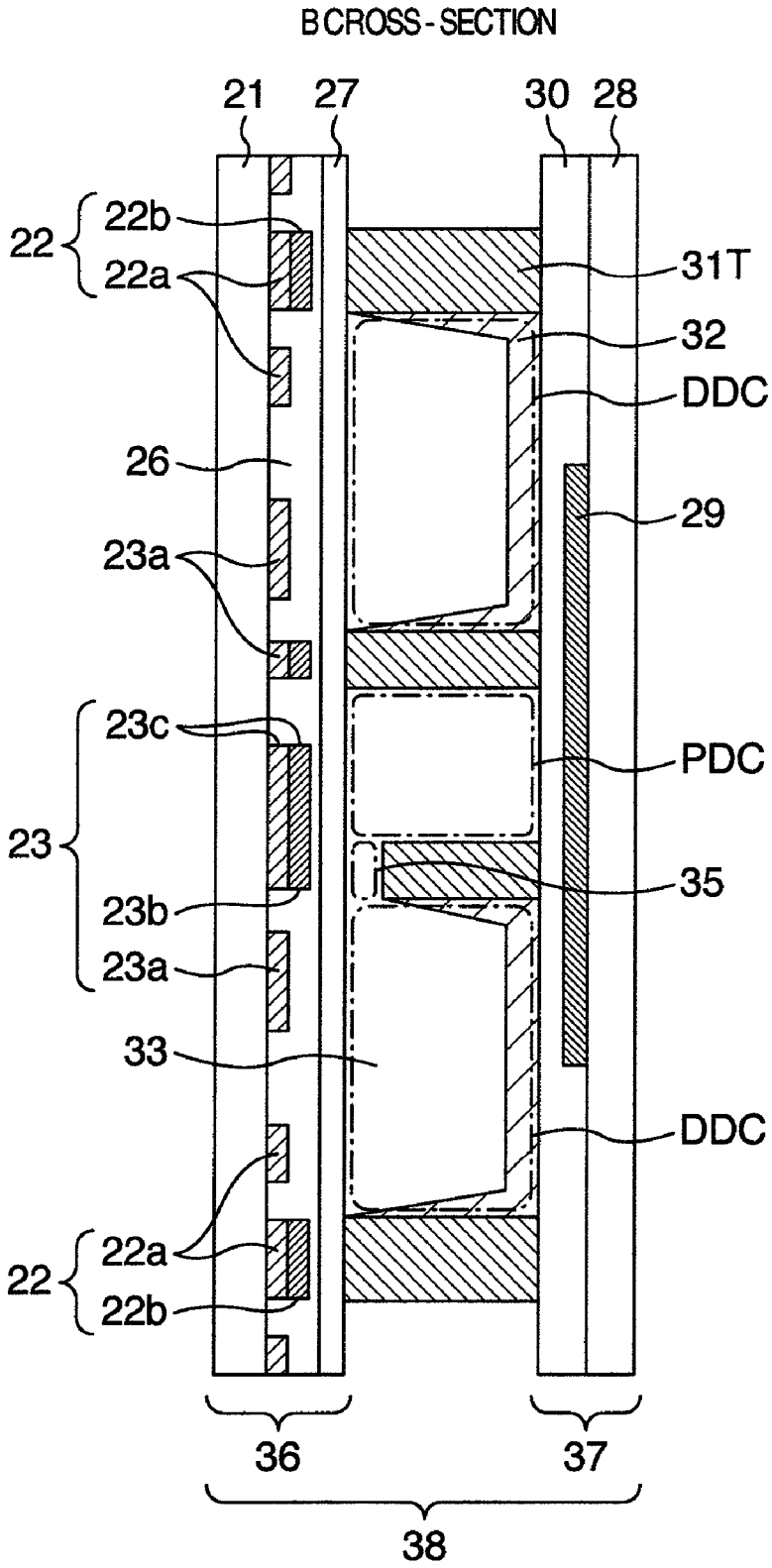
FIG. 29 is a cross-sectional view along the B line of FIG. 28.

FIGS. 28 and 29 are drawings schematically showing the fourth embodiment relevant to the present invention; FIG. 28 is a front view showing a part of a PDP cell structure in the fourth embodiment, and FIG. 29 is a cross-sectional view along the B line of FIG. 28.

(Explanation on the Configuration)

A PDP in this fourth embodiment is designed such that a T-character shaped part of the X transparent electrode 22*a* and a T-character shaped part of the Y transparent electrode 23*a*, which were designed to have the same shape and the same area in the first embodiment above, have an effective ratio of electrode areas thereof of 1:2. Here, the effective electrode area in the present specification is defined as "electrode area within a range contained in the display discharge cell DDC".

In the first embodiment, the priming discharge cell PDC has wide space and the X electrode is standardized to the one by the display discharge cell DDC adjacent in the row direction. Because of the influence of these, as compared with a configuration of a conventional embodiment, the position of an average visible emission center in the sustained discharge comes nearer to the X electrode 22 side than the Y electrode 23 side. In this case, there is risk to generate an adverse effect on the display quality of a PDP.

Figure 30A:
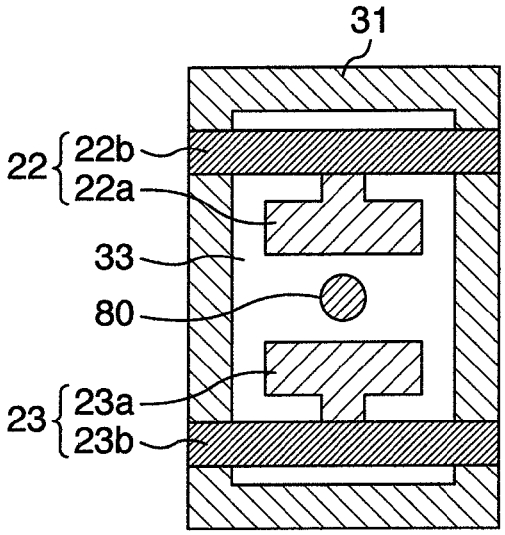
FIGS. 30A and 30B are front elevation views schematically showing a display discharge cell and the center of visible emission intensity thereof.
Figure 30B:
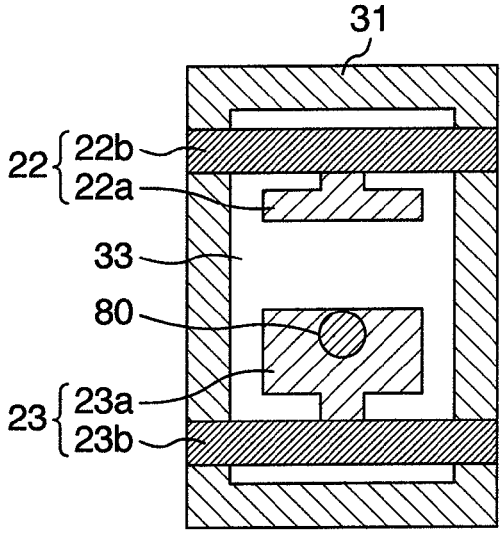
Figure 31A:
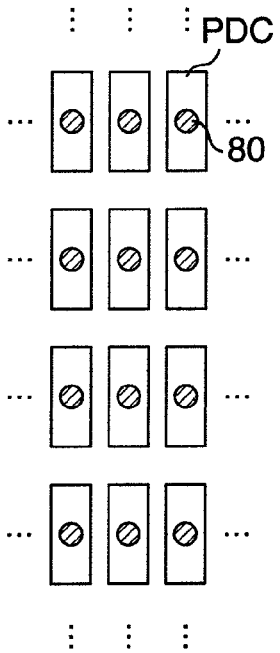
FIGS. 31A, 31B and 31C are schematic drawings showing arrangement of a display discharge cell.
Figure 31B:
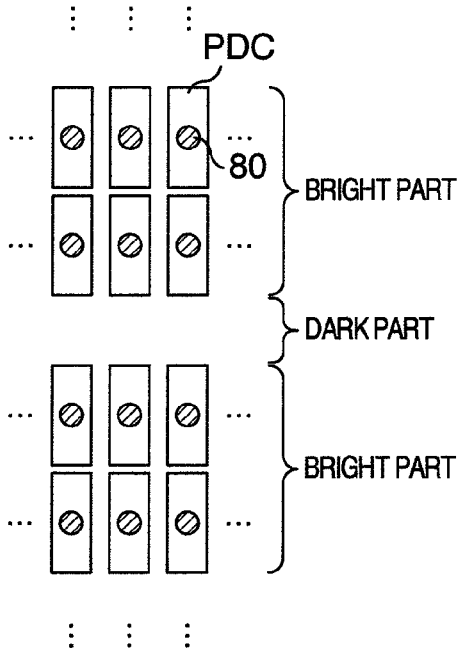
Figure 31C:
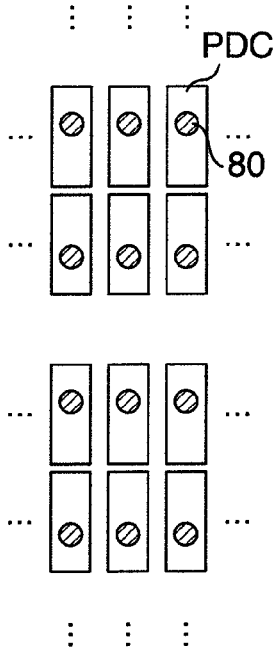

Explanation will be given next on this adverse effect with reference to drawings. FIG. 30A is a front view schematically showing one display discharge cell. As described above, by inversion of the relative voltage relation (which one is an anode and which one is a cathode) of the X electrode and the Y electrode in the sustained discharge, the sustained discharge is repeated, ultraviolet rays generated each time from the plasma excite the fluorescent material and generates visible light. Therefore, the center 80 of visible emission intensity, when viewed in average, is the center position of the display discharge cell DDC. In a usual PDP, as shown in FIG. 31A, the display discharge cell DDC is arranged at the same interval in each of the line direction and the row direction, configurating each sub-pixel, and an image is displayed. That is, the display discharge cell DDC is arranged in the row direction at a frequency of every one cell. On the other hand, as shown in FIG. 31B, in the case where the display discharge cell DDC is arranged in the row direction at a frequency of every two cells, the center 80 of visible emission intensity displaces similarly as the position of the display discharge cell. Therefore, for example, in displaying white over a whole view screen, there is provided frequency unevenness of a display line by each two lines, wherein a bright (line) part composed of 2 close lines each other, and a dark (line) part present between the bright (line) parts are repeated. It provides feeling of wrongness in display, when it becomes large enough to be recognizable by human eyes. To prevent this, as shown in FIG. 30B, by making the width in the row direction of the Y transparent electrode 23*a* larger, and making the width in the row direction of the X transparent electrode 22*a* smaller, the Y transparent electrode 23*a* side can be brighter in average, and the center 80 of visible emission intensity can be displaced to the Y electrode 23 side. In this way, in the case of the XYYX arrangement, as shown in FIG. 31C, displacement of the display discharge cell DDC can be compensated by the change of the width in the row direction of the Y transparent electrode 23*a*.

Therefore, by taking such a configuration as in the fourth embodiment, the average emission center in the sustained discharge can be displaced to the Y electrode 23 side having large electrode area, and can prevent the deterioration of display quality.

In addition, because the area of the T-character shaped part in the Y transparent electrode 23*a* becomes large, an effective region where voltage is applied is extended, and the address discharge characteristics in the display discharge cell DDC can be improved.

Here, in the first embodiment, the Y convex electrode 23*c*, when viewed in the line direction, is arranged in --A-A'-A'-A-A-A'-A'-A-A---, however, as in the fourth embodiment, it may be arranged ---A-A'-A-A'-A-A'-A-A'-A--. It should be noted that "A" here means that the Y convex electrode 23*c* protrudes from the Y electrode 23 on the A line side, and "A'" means that the Y convex electrode 23*c* protrudes from the Y electrode 23 on the A' line side.

Other configurations and the drive operation are similar as in the PDP shown in the first embodiment described above.

Embodiment 5

Figure 32:
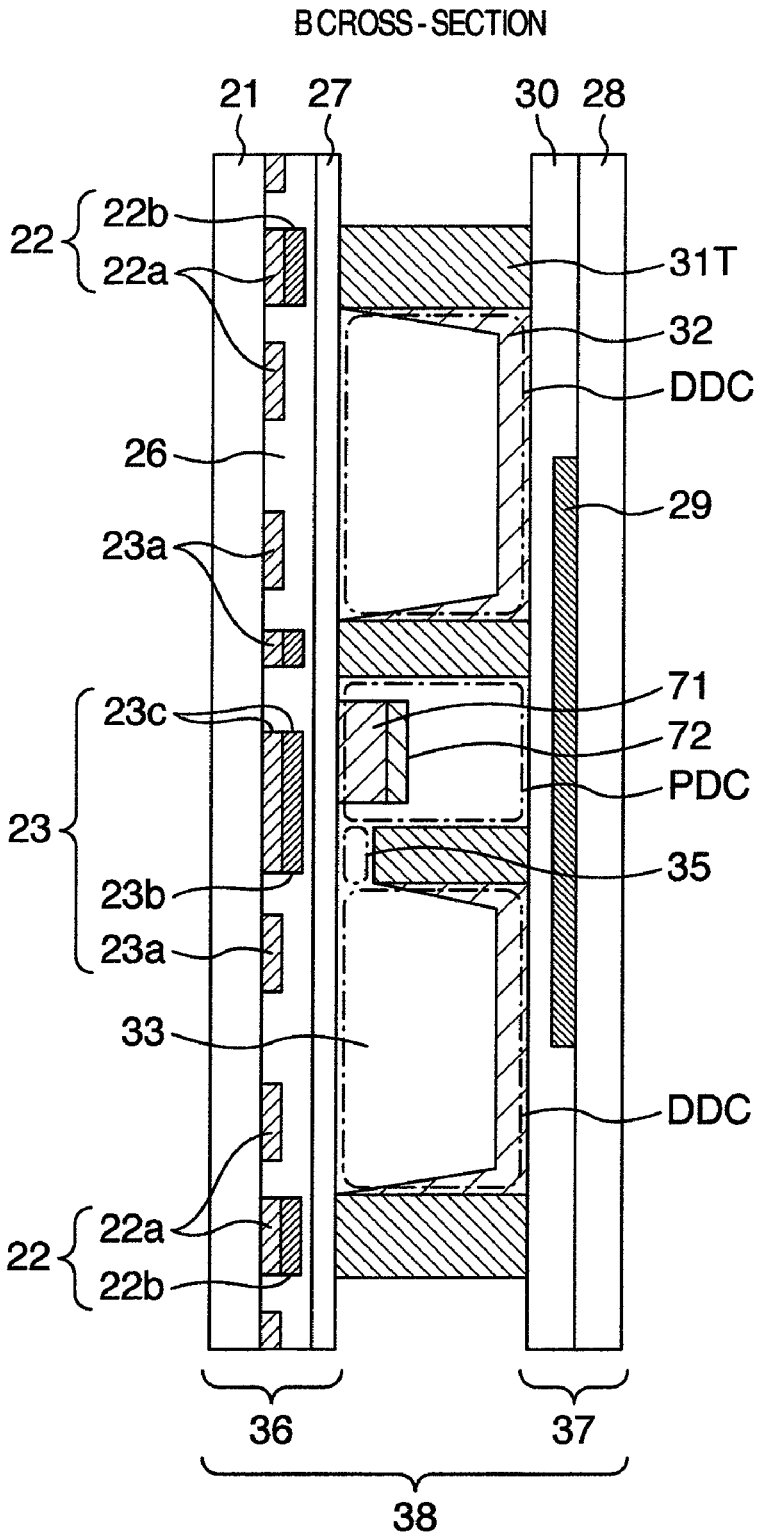
FIG. 32 is a cross-sectional view schematically showing the fifth embodiment.

FIG. 32 is a drawing schematically showing the fifth embodiment relevant to the present invention. A fundamental configuration is similar as in the PDP in the first embodiment shown in FIG. 1. FIG. 32 is a cross-sectional view at the same position along the B line of FIG. 1.

(Explanation on Configuration)

A PDP in this fifth embodiment is provided with a height adjustment layer 71 in a region where the priming discharge cell PDC is present, on the protective film 27 in the front plate 36 (a side with the discharge space 33), in the first embodiment above. In addition, on the height adjustment layer 71, an electron discharge layer 72 is provided.

By taking such a configuration, as compared with the first embodiment, a distance of discharge space between the Y convex electrode 23*c* and the A electrode 29 in the priming discharge cell PDC can be shortened effectively, discharge initiation voltage of priming discharge can be lowered, or discharge delay time of priming discharge can be shortened. In addition, by the electron discharge layer 72, the discharge initiation voltage of priming discharge can be lowered further, or the discharge delay time of priming discharge can be shortened further.

Furthermore, according to the present configuration, because wider discharge space can be secured, formation of the height adjustment layer 71 and the electron discharge layer 72 becomes easy. In addition, as for the electron discharge layer 72, because wider discharge space can be secured, effect of the electron discharge can be enhanced. The reason is considered that with the increase in the area of the surface facing to discharge gas among the electron discharge layer, the number of effective atoms and trap levels, which becomes electron discharge sources, is increased.

The height adjustment layer 71 is provided mainly aiming at shortening the distance of the discharge space, and a material thereof is not especially limited, however, it is formed by using, for example, a dielectric material of the same kind as the dielectric layer 26. General glass materials (relative dielectric constant=3 to 10) may be used. In addition, because a material with the higher relative dielectric constant can suppress the voltage drop by the height adjustment layer 71, a material with high relative dielectric constant such as $TiO_2$ (relative dielectric constant=approximately 100) may be used.

As the electron discharge layer 72, it is preferable to use a material having a high secondary electron discharge coefficient, or a material having a small value of work function. For example, an oxide of an alkali metal, an oxide of an alkaline earth metal (for example, BaO, SrO, CaO or the like), a rare earth oxide, a fluoride or the like is included.

It should be noted that the height adjustment layer 71 is arranged on the protective film 27 (on the side with discharge space 33) in FIG. 32, however, it may be arranged under the protective film 27.

Other configurations and the drive operation are similar as in the PDP shown in the first embodiment described above.

Embodiment 6

Figure 33:
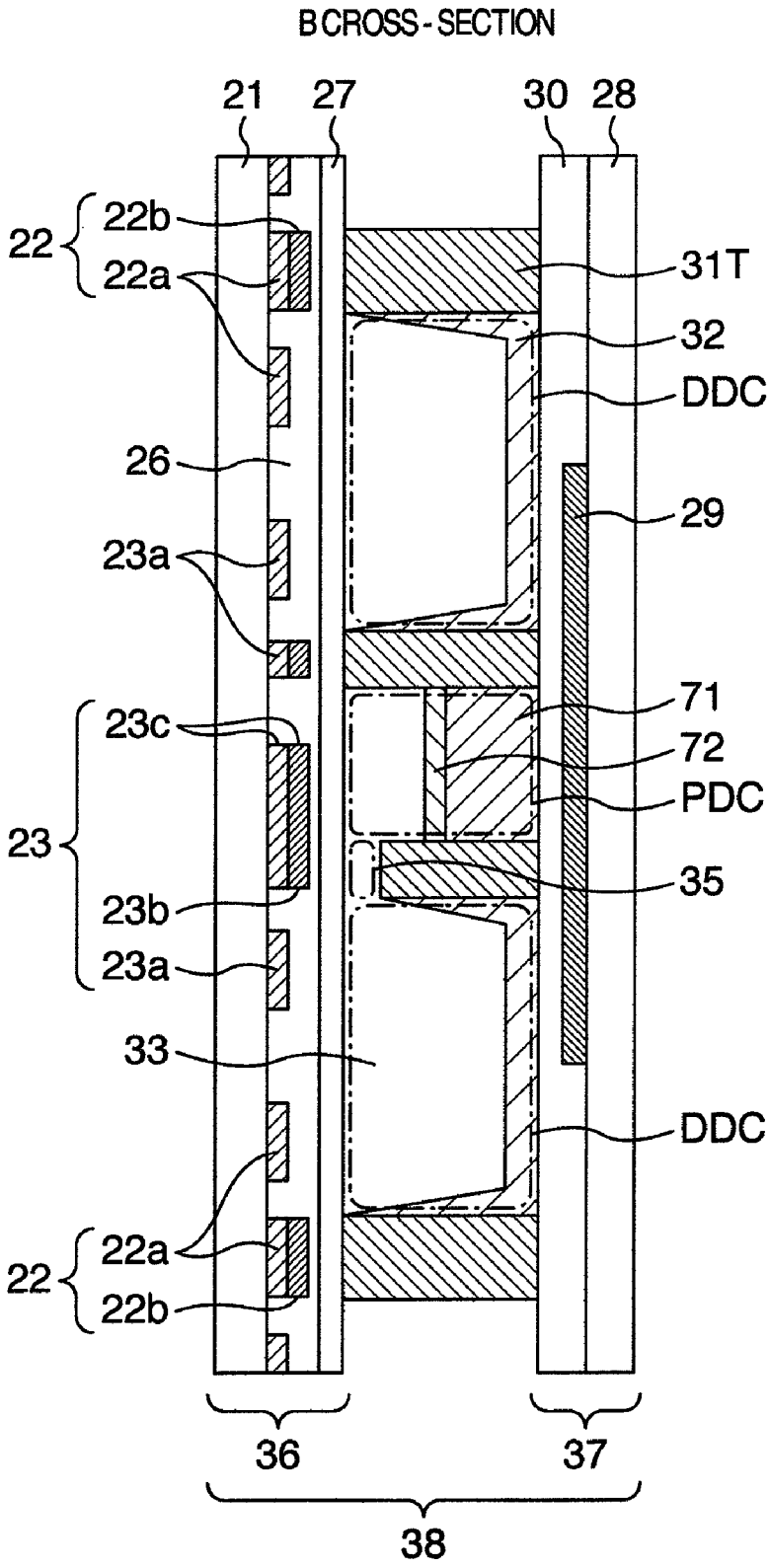
FIG. 33 is a cross-sectional view schematically showing the sixth embodiment.

FIG. 33 is a drawing schematically showing the sixth embodiment relevant to the present invention. A fundamental configuration is similar as in the PDP in the first embodiment shown in FIG. 1. FIG. 33 is a cross-sectional view at the same position along the B line of FIG. 1.

(Explanation on Configuration)

A PDP in this sixth embodiment is provided with a height adjustment layer 71 in a region where the priming discharge cell PDC is present, on the dielectric layer 30 in the rear plate 37 (a side with the discharge space 33), in the first embodiment above. In addition, on the height adjustment layer 71, an electron discharge layer 72 is provided.

By taking such a configuration, as compared with the first embodiment, the distance of the discharge space between the Y convex electrode 23*c* and the A electrode 29, in the priming discharge cell PDC, can be shortened effectively, the discharge initiation voltage of priming discharge can be lowered, or the discharge delay time of priming discharge can be shortened. In addition, by the electron discharge layer 72, the discharge initiation voltage of the priming discharge can be lowered further, or the discharge delay time of the priming discharge can be shortened further.

Furthermore, according to the present configuration, because wider discharge space can be secured, formation of the height adjustment layer 71 and the electron discharge layer 72 becomes easy. In addition, as for the electron discharge layer 72, because wider discharge space can be secured, effect of the electron discharge can be enhanced. The reason is considered that with the increase in the area of the surface facing to discharge gas in the electron discharge layer, the number of effective atoms and trap levels, which are electron discharge sources, is increased.

The height adjustment layer 71 is provided mainly aiming at shortening the distance of the discharge space, and a material thereof is not especially limited, however, it is formed by using, for example, a dielectric material of the same kind as the dielectric layer 30. In addition, use of the rib 31 makes it possible to form the height adjustment layer 71 in the same step as a process for forming the rib. General glass materials (relative dielectric constant=3 to 10) may be used. In addition, because a material with the higher relative dielectric constant can suppress the voltage drop by the height adjustment layer 71, a material with high relative dielectric constant such as $TiO_2$ (relative dielectric constant=approximately 100) may be used.

As the electron discharge layer 72, it is preferable to use a material having high secondary electron discharge coefficient, or a material having small value of work function. For example, an oxide of an alkali metal, an oxide of an alkaline earth metal (for example, BaO, SrO, CaO or the like), a rare earth oxide, a fluoride or the like is included.

It should be noted that the height adjustment layer 71 is arranged on the dielectric layer 30 (on the side with discharge space 33), in FIG. 33, however, it may be arranged under the protective film 27.

Other configurations and the drive operation are similar as in the PDP shown in the first embodiment described above.

Embodiment 7

Figure 34:
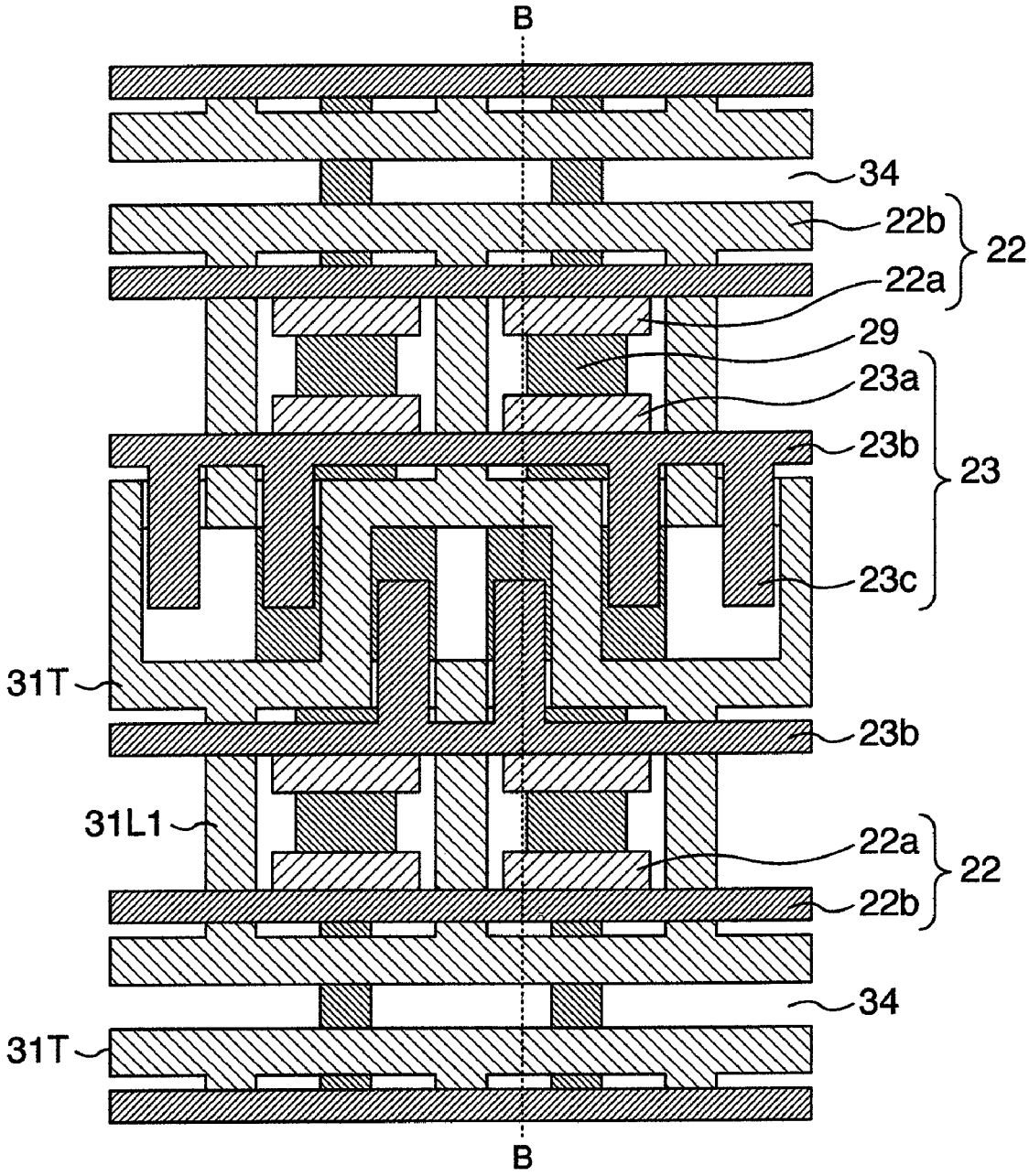
FIG. 34 is a cross-sectional view schematically showing the seventh embodiment.
Figure 35:
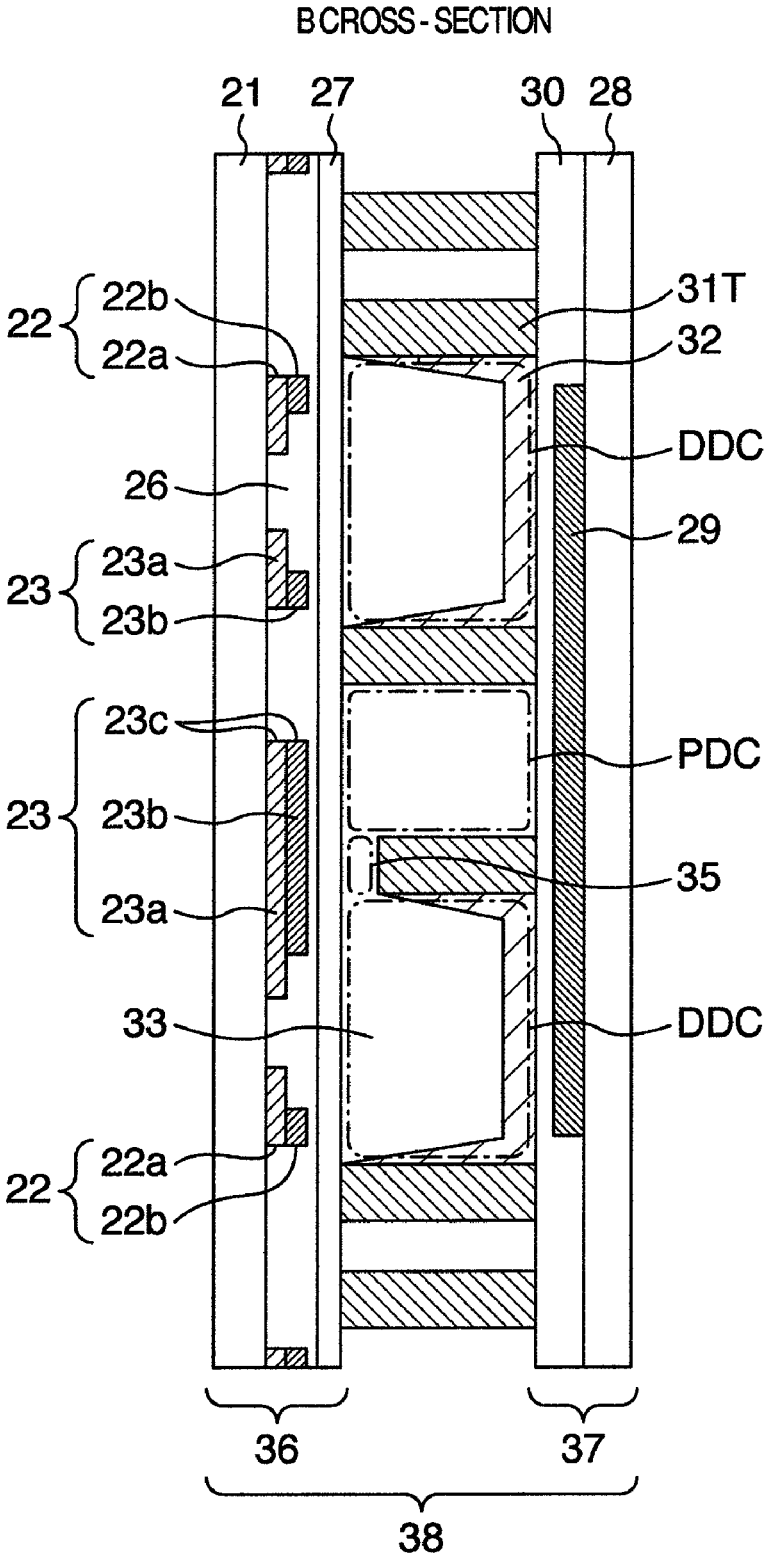
FIG. 35 is a cross-sectional view along the B line of FIG. 34.

FIG. 34 is a drawing schematically showing the seventh embodiment relevant to the present invention. A fundamental configuration is similar as in PDP in the first embodiment shown in FIG. 1. FIG. 34 is a cross-sectional view at the same position along the B line of FIG. 1.

(Explanation on the Configuration)

A PDP in this seventh embodiment is designed to have two X electrodes, which was designed to be single by electric connection in the first embodiment above. By taking such a configuration, it becomes possible to apply different voltage waveform to each of X electrodes.

In addition, a region without a rib (the inter-line region 34) sandwiched by the traverse rib 31T was provided in a region between each of the display discharge cells DDCs adjacent in the row direction. By taking such a configuration, it becomes possible to enhance exhaustion efficiency in an exhaustion process, by utilizing a region where the traverse rib 31T under the X electrode was present as an exhaustion path.

Furthermore, the X bus electrode 22*b* and the Y bus electrode 23*b* are arranged in a region sandwiching the display discharge cell DDC, not in a region facing to the A electrode sandwiching the traverse rib 31T. By taking such a configuration, it becomes possible to make apart distance between the Y bus electrode 23*b* and the priming discharge cell PDC, and therefore, influence of displacement in the up and down directions in laminating the front plate 36 and the rear plate 37 can be mitigated. The influence by displacement means scanning interference generated in an arrangement where the Y bus electrode 23*b* faces to the A electrode 29, sandwiching the priming discharge cell PDC, as described, for example, in the first embodiment.

Other configurations and drive motion are similar as in the PDP shown in the first embodiment described above.

It should be further understood by those skilled in the art that although the foregoing description has been made on embodiments of the invention, the invention is not limited thereto and various changes and modifications may be made without departing from the spirit of the invention and the scope of the appended claims.

The invention claimed is:

1. A plasma display apparatus comprising at least:

a front substrate;

a plurality of first electrodes and second electrodes extending in a line direction, in which each two thereof are arranged alternately in a row direction on said front substrate;

a dielectric layer covering said first electrode and said second electrode;

a back substrate;

a plurality of address electrodes extending in the row direction, which are arranged on said back substrate in the line direction opposed to said first electrode and said second electrode;

a plurality of first longitudinal ribs extending in the row direction;

a plurality of traverse ribs extending in the line direction;

a plurality of display discharge cells formed by said first longitudinal ribs and said traverse ribs;

a priming discharge region formed between said traverse ribs of said adjacent display discharge cells of said second electrode, among said display discharge cells adjacent in the row direction;

a second longitudinal rib extending in the row direction on an extended line of said first longitudinal rib and partitioning said priming discharge region;

a third longitudinal rib extending in the row direction and further partitioning between said second longitudinal ribs into two sections;

a priming discharge cell formed by said second longitudinal ribs, said third longitudinal ribs and said traverse ribs; and a convex electrode extended from said adjacent two second electrodes to said each separate priming discharge cell, on the side facing each other of said two second electrodes adjacent in the row direction;

wherein there is a gap spatially connecting said display discharge cell and said priming discharge cell, between said front substrate and said traverse rib partitioning said display discharge cell and said priming discharge cell, and a sum of a width in the line direction of a region formed by said second longitudinal ribs and said traverse ribs, and a pattern width of said second longitudinal ribs, is larger than a sum of a width in the row direction of a region formed by said second longitudinal ribs and said traverse ribs, and a pattern width of said traverse ribs.

2. The plasma display apparatus according to claim 1, wherein effective electrode areas of said first electrode and said second electrode are different each other.

3. The plasma display apparatus according to claim 1, wherein a width in the line direction of an address electrode in said priming discharge region is larger than a width in the line direction of an address electrode in other region.

4. The plasma display apparatus according to claim 1, wherein a height adjustment layer composed of a dielectric material or an electric conductive material is provided on said front substrate side, in said priming discharge cell.

5. The plasma display apparatus according to claim 1, wherein an electron discharge layer is provided on said front substrate side, in said priming discharge cell.

6. The plasma display apparatus according to claim 1, wherein a height adjustment layer composed of a dielectric material or an electric conductive material is provided on said back substrate side, in said priming discharge cell.

7. The plasma display apparatus according to claim 1, wherein an electron discharge layer is provided on said back substrate side, in said priming discharge cell.

8. The plasma display apparatus according to claim 1, wherein one first electrode is used instead of the two first electrodes adjacent in said row direction.

9. A plasma display apparatus comprising at least:

a front substrate;

a plurality of first electrodes and second electrodes extending in a line direction, in which each two thereof are arranged alternately in a row direction on said front substrate;

a dielectric layer covering said first electrode and said second electrode;

a back substrate;

a plurality of address electrodes extending in the row direction, which are arranged on said back substrate in the line direction opposed to said first electrode and said second electrode;

a plurality of first longitudinal ribs extending in the row direction;

a plurality of traverse ribs extending in the line direction;

a plurality of display discharge cells formed by said first longitudinal ribs and said traverse ribs;

a priming discharge region formed between said traverse ribs of said adjacent display discharge cells of said second electrode, among said display discharge cells adjacent in the row direction;

a second longitudinal rib extending in the row direction and partitioning said priming discharge region;

a priming discharge cell formed by said second longitudinal ribs and said traverse ribs; and a convex electrode extended from said adjacent two second electrodes to said each separate priming discharge cell, on the side facing each other of said two second electrodes adjacent in the row direction;

wherein there is a gap spatially connecting said display discharge cell and said priming discharge cell, between said front substrate and said traverse rib partitioning said display discharge cell and said priming discharge cell, and said second longitudinal ribs are not present on an extended line of said first longitudinal ribs.

10. The plasma display apparatus according to claim 9, wherein a sum of a width in the line direction of a region formed by said second longitudinal ribs and said traverse ribs, and a pattern width of said second longitudinal ribs is larger than a sum of a width in the row direction of a region formed by said second longitudinal ribs and said traverse ribs and a pattern width of said traverse ribs.

11. The plasma display apparatus according to claim 9, wherein effective electrode areas of said first electrode and said second electrode are different each other.

12. The plasma display apparatus according to claim 9, wherein a width in the line direction of an address electrode in said priming discharge region is larger than a width in the line direction of an address electrode in other region.

13. The plasma display apparatus according to claim 9, wherein a height adjustment layer composed of a dielectric material or an electric conductive material is provided on said front substrate side, in said priming discharge cell.

14. The plasma display apparatus according to claim 9, wherein an electron discharge layer is provided on said front substrate side, in said priming discharge cell.

15. The plasma display apparatus according to claim 9, wherein a height adjustment layer composed of a dielectric material or an electric conductive material is provided on said back substrate side, in said priming discharge cell.

16. The plasma display apparatus according to claim 9, wherein an electron discharge layer is provided on said back substrate side, in said priming discharge cell.

17. The plasma display apparatus according to claim 9, wherein only one first electrode is used instead of the two first electrodes adjacent in said row direction.

18. A plasma display apparatus comprising at least:

a front substrate;

a plurality of first electrodes and second electrodes extending in a line direction, in which each two thereof are arranged alternately in a row direction on said front substrate;

a dielectric layer covering said first electrode and said second electrode;

a back substrate;

a plurality of address electrodes extending in the row direction, which are arranged on said back substrate in the line direction opposed to said first electrode and said second electrode;

a plurality of first longitudinal ribs extending in the row direction;

a plurality of traverse ribs extending in the line direction;

a plurality of display discharge cells formed by said first longitudinal ribs and said traverse ribs;

a priming discharge region formed between said traverse ribs of said adjacent display discharge cells of said second electrode, among said display discharge cells adjacent in the row direction;

a rib for the priming discharge region, which connects an intersection of said first longitudinal rib and said traverse rib on said priming discharge region side in one said display discharge cell among said display discharge cells sandwiching said priming discharge region and adjacent in the row direction, and an intersection of said first longitudinal rib and said traverse rib on said priming discharge region side in the other said display discharge cell, and extends in a direction different from on the extended line of said first longitudinal rib, and partitions said priming discharge region;

a priming discharge cell formed by said rib for priming discharge region and said traverse rib; and a convex electrode extended from said adjacent two second electrodes to said each separate priming discharge cell, on the side facing each other of said two second electrodes adjacent in the row direction;

wherein there is a gap spatially connecting said display discharge cell and said priming discharge cell, between said front substrate and said traverse rib partitioning said display discharge cell and said priming discharge cell.

19. The plasma display apparatus according to claim 18, wherein an extended line of said first longitudinal rib of said one of the display discharge cells forming one of the intersections, and an extended line of said first longitudinal rib of said other display discharge cells designating the other intersections, in said intersections connected by ribs for said priming discharge region, are adjacent each other.

20. The plasma display apparatus according to claim 18, wherein effective electrode areas of said first electrode and said second electrode are different each other.

21. The plasma display apparatus according to claim 18, wherein a width in the line direction of an address electrode in said priming discharge region is larger than a width in the line direction of an address electrode in other region.

22. The plasma display apparatus according to claim 18, wherein a height adjustment layer composed of a dielectric material or an electric conductive material is provided on said front substrate side, in said priming discharge cell.

23. The plasma display apparatus according to claim 18, wherein an electron discharge layer is provided on said front substrate side, in said priming discharge cell.

24. The plasma display apparatus according to claim 18, wherein a height adjustment layer composed of a dielectric material or an electric conductive material is provided on said back substrate side, in said priming discharge cell.

25. The plasma display apparatus according to claim 18, wherein an electron discharge layer is provided on said back substrate side, in said priming discharge cell.

26. The plasma display apparatus according to claim 18, wherein one first electrode is used instead of the two first electrodes adjacent in said row direction.

* * * * *